US006009720A

United States Patent [19]

Ji et al.

[11] Patent Number: 6,009,720

[45] Date of Patent: Jan. 4, 2000

[54] REFRIGERATOR HAVING COOL AIR DISPERSING BLADES

[75] Inventors: Joon Dong Ji, Suwon; Jae In Kim, Seoul, both of Rep. of Korea

[73] Assignee: Samsung Electronics Co., Ltd., Suwon, Rep. of Korea

[21] Appl. No.: 09/107,278

[22] Filed: Jun. 30, 1998

[30] Foreign Application Priority Data

| | | | |
|---|---|---|---|
| Jun. 30, 1997 | [KR] | Rep. of Korea | 97-29766 |
| Jun. 30, 1997 | [KR] | Rep. of Korea | 97-29767 |
| Oct. 2, 1997 | [KR] | Rep. of Korea | 97-51041 |
| Oct. 2, 1997 | [KR] | Rep. of Korea | 97-51042 |

[51] Int. Cl.[7] ..... F25D 17/06

[52] U.S. Cl. ..... 62/413; 62/419

[58] Field of Search ..... 62/413, 414, 419, 62/426; 454/285

[56] References Cited

U.S. PATENT DOCUMENTS

| | | | |
|---|---|---|---|
| 4,462,304 | 7/1984 | Hashimoto | 454/285 |
| 5,718,123 | 2/1998 | Park et al. | 62/419 |
| 5,735,138 | 4/1998 | Park et al. | 62/419 |
| 5,755,112 | 5/1998 | Kang | 62/419 |
| 5,775,124 | 7/1998 | Park et al. | 62/414 |

*Primary Examiner*—William E. Tapolcai
*Attorney, Agent, or Firm*—Burns, Doane, Swecker & Mathis, L.L.P.

[57] ABSTRACT

Disclosed is a refrigerator having a cabinet for forming a cooling compartment, and a duct for forming a passage of cool air. The duct is provided in an inner wall of the cooling compartment and has at least one cool air discharge port opened into the cooling compartment. The refrigerator has a pair of horizontal-dispersing blades disposed near the cool air discharge port in the duct, a rotational shaft connected with the horizontal-dispersing blades and extended along a vertical axis, and a motor for driving the rotational shaft. The cool air is uniformly dispersed in the cooling compartment.

23 Claims, 28 Drawing Sheets

REFRIGERATOR HAVING COOL AIR DISPERSING BLADES

BACKGROUND OF THE INVENTION

1. Field of the Invention

The present invention relates to a refrigerator having a cabinet for forming a cooling compartment, and a duct for forming a passage of cool air, which is provided in an inner wall of the cooling compartment and has at least one cool air discharge port opened into the cooling compartment, and more particularly relates to a refrigerator having a device for dispersing cool air uniformly into the cooling compartment.

2. Prior Art

In general, a refrigerator has a cabinet for forming a pair of cooling compartments, i. e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air which is comprised of a compressor, a condenser and an evaporator. The cool air generated by the evaporator flows along a supply duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method which has amended such a problem has been proposed. In the refrigerator adopting the tri-dimensional cooling method, the cool air discharge ports are provided at both side walls as well as at the real wall of the cooling compartment in order to promote the uniform cooling However, in such a refrigerator adopting the tri-dimensional cooling method, since the cool air is discharged through the cool air discharge ports in fixed directions, there may be a dead-zone at all edge area which is not supplied with the cool air sufficiently. In particular, since the supply duct has to be provided not only in the rear wall but also in the side walls, there are problems that the space for storing food is reduced and the manufacturing cost increases due to the increased number of components and processes.

The uniform distribution of cool air has risen to an important problem in relation to the trend to use large-sized refrigerator.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

The conventional refrigerator having the device for dispersing cool air has a pair of cooling compartments 2 and 3 in a cabinet 1, which are partitioned from each other by a partitioning wall 5. The cooling compartments 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a supply duct 15 and a return duct 17 separated from each other by a seal plate 25 are provided between the duct plate 9 and a rear wall 4 of the cabinet 1. In the supply duct 15 is installed a duct member 21 for guiding the cool air blown by the fresh food compartment fan 13*b* downwardly. The cool air venerated by the fresh food compartment evaporator 12*b* is blown by the fresh food compartment fan 13*b*, and then supplied to the fresh food compartment 3 via the supply duct 15 and the cool air discharge points 16.

A cool air dispersing device 130 is installed in the supply duct 15. The cool air dispersing device 130 is comprised of a rotational shaft 131 having a vertical axis, cool air dispersing blades 132 assembled with the rotational shaft 131 in correspondence with the cool air discharge ports 16 respectively, and a driving motor 135 for rotating the rotational shaft 131. Each of the cool air dispersing blades 132 is comprised of three discs 136, 137 and 138 disposed in parallel with each other along the axis direction, and a first blade part 133 and a second blade part 134 disposed between the discs 136, 137 and 138. Each of the blade parts 133 and 134 are bent so that their cross section is a lax shape of alphabet S. The blade parts 133 and 134 are bent to the opposite directions to each other.

In the refrigerator having the above-described constitution, when the driving motor 131 rotates the rotational shaft 131 at a low speed, the cool air flowing alone the supply duct 15 chances its flowing, direction along the bent surface of the cool air dispersing blades 132, and is discharged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132 so that the cool air is concentrated on the specific area.

However, since the blade parts 133 and 134 of the cool air dispersing device 130 are bent to be shaped into the lax alphabet S, left or right side of the fresh food compartment 3 may not be supplied with the cool air sufficiently according to the rotational direction of the rotational shaft 131, and the smooth flow of cool air may be impeded by a vortex of the cool air formed about the cool air discharge ports 16.

Moreover, although such a conventional cool air dispersing device 130 can achieve the uniform distribution of the cool air horizontally, the vertical distribution of the cool air cannot be uniform sufficiently, so there is a limitation in realizing the uniform cooling through the overall area of the fresh food compartment 3.

SUMMARY OF THE INVENTION

The present invention has been proposed to overcome tile above-described problems in the prior art, and accordingly it is the object of the present invention to provide a refrigerator having a cool air dispersing device capable of achieving effectively the uniform distribution of cool air horizontally.

Another object of the present invention is to provide a refrigerator having a cool air dispersing device capable of distributing cool air uniformly not only in horizontal direction but also in vertical direction.

To achieve the above object, the present invention provides a refrigerator having a cooling compartment for storing food, and a duct being provided in a side wall of said cooling compartment, said duct for forming a cool air passage, said duct having at least one cool air discharge port opened into said cooling compartment, said refrigerator comprising: a pair of horizontal-dispersing blades of planar plate shape being disposed near the cool air discharge port in said duct, said horizontal-dispersing blades being spaced from each other at a predetermined distance and being disposed at opposite sides to each other with a vertical axis disposed therebetween; a rotational shaft being connected with said horizontal-dispersing blades, said rotational shaft being extended along the vertical axis; and a motor for driving said rotational shaft.

It is preferable to further comprise a connecting bar for connecting said horizontal-dispersing blades with each other, wherein said rotational shaft is assembled with said connecting bar.

In order to achieve effective dispersing of cool air, it is preferable that said cooling compartment is divided into a plurality of storing areas which are stratified vertically and correspond to at least one of the cool air discharge ports, and the cool air discharge port has a shape of a partial cylinder. Additionally, it is possible that the cool air discharge ports are linearly arranged, and said horizontal-dispersing blades are extended throughout all of the cool air discharge ports. However, it is even more preferable if a pair of said horizontal-dispersing blades are disposed at each of the cool air discharge ports, and the horizontal-dispersing blades in each pair are connected with each other by said rotational shaft.

According to the preferred embodiment of the present invention, a connecting plate is assembled at both ends of said horizontal-dispersing blades so as to connect said pair of horizontal-dispersing blades with each other, and said rotational shaft is assembled in a body with said connecting plate.

According to another preferred embodiment of the present invention, at least one outer auxiliary blade is assembled at an outer surface of said horizontal-dispersing, blade so as to protrude therefrom, whereby the uniform dispersing of cool air in vertical direction is promoted. It is preferable that said outer auxiliary blade is orthogonal with respect to said horizontal-dispersing blade, and is tilted against the vertical axis. Said outer auxiliary blade is formed into a semi-disc shape.

In order to facilitate the installation process of the outer auxiliary blade, it is preferable that said outer auxiliary blade has a pair of installation pins, and said horizontal-dispersing blade is formed with a pair of fixing holes engaged with said installation pins. Furthermore, if one of said fixing holes is formed into a long hole, it is possible to regulate a tilt of said outer auxiliary blade.

The dispersing of cool air in vertical direction is achieved by a central auxiliary blade disposed between said pair of horizontal-dispersing blades. In order to facilitate the installation process of the central auxiliary blade, it is preferable that said central auxiliary blade has a pair of installation pins, and said horizontal-dispersing blade is formed with a pair of fixing holes engaged with said installation pins. Furthermore, if one of said fixing holes is formed into a long hole, it is possible to regulate a tilt of said central auxiliary blade.

According to another embodiment, an additional horizontal-dispersing blade is disposed in parallel with said pair of horizontal-dispersing blades. Said additional horizontal-dispersing blade is preferably disposed along the vertical axis.

According to still another embodiment, in order to dispersing the cool air uniformly in vertical direction, the refrigerator further comprises at least one vertical-dispersing blade installed near the cool air discharge ports to be capable of pivoting about a horizontal rotational axis; and a means for pivoting said vertical-dispersing blade in a vertical direction.

In this situation, it is preferable that said vertical-dispersing blade pivots in a predetermined angular range. Said pivoting means comprises: a link member having a plurality of hinge assembly parts respectively assembled with said vertical-dispersing blades at positions distanced from said horizontal axis, said link member being capable of moving up and down in the vertical direction; and a means for elevating/de-elevating said link member.

Said elevating/de-elevating means comprises: an elevation/de-elevation cam being installed on said rotational shaft of said horizontal-dispersing blade, said elevation/de-elevation cam rotating together with said rotational shaft; and an operation part formed in a body with said link member, said operation part interacting with said elevation/de-elevation cam so that a rotational movement of said elevation/de-elevation cam is transmitted to said link member as an elevational/de-elevational movement thereof. Here, It is preferable that said elevation/de-elevation cam has a cylindrical cam body coaxially installed on said rotational shaft, and a cam groove which is a closed loop having an elevational/de-elevational cam profile at an outer surface of said cam body; and said operation part protrudes from said link member and is engaged with said cam groove. It is even more preferable to further comprises a means for guiding said link member so as to be capable of moving tip and down vertically while preventing rotation of said link member, wherein said guiding means comprises: a guiding piece protruding along an axis of said link member; and a guiding part formed at an inner surface of said duct, said guiding part into which said guiding piece is inserted to be capable of moving tip and down.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
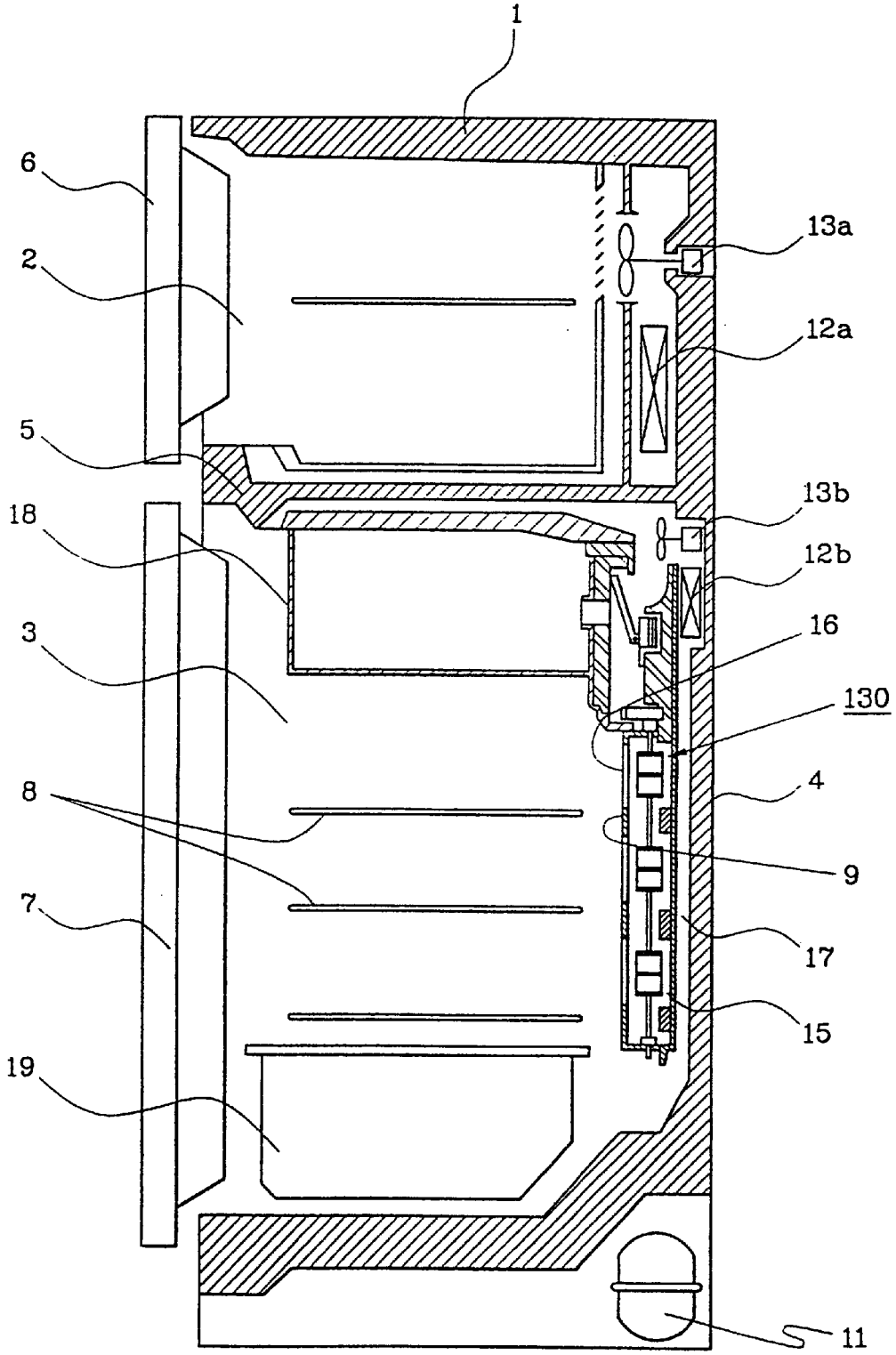
FIG. 1 (PRIOR ART)
FIG. 1 is a side sectional view of a conventional refrigerator having cool air dispersing blades.
Figure 2:
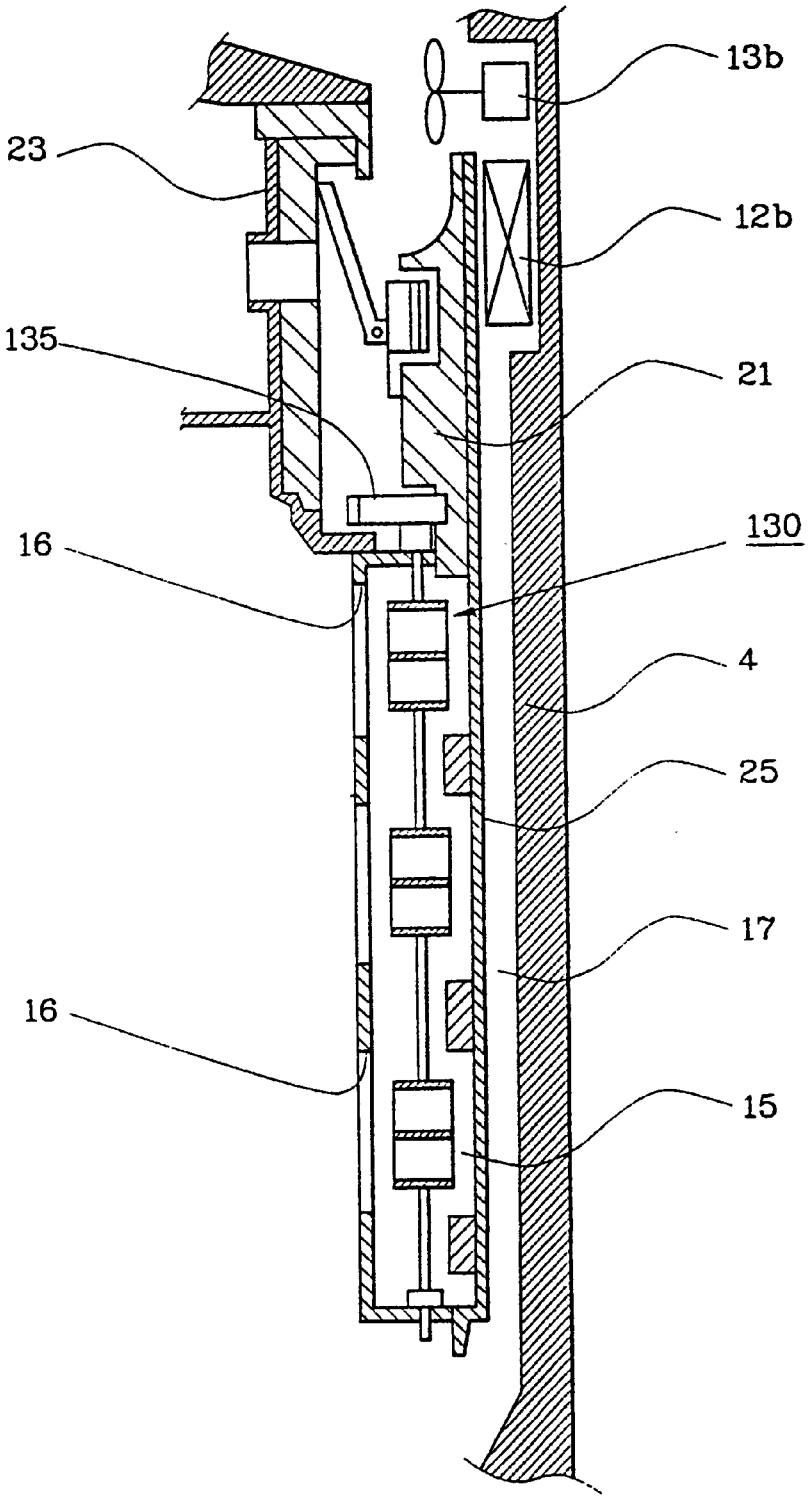
FIG. 2 (PRIOR ART)
FIG. 2 is a partial enlarged sectional view of FIG. 1.
Figure 3:
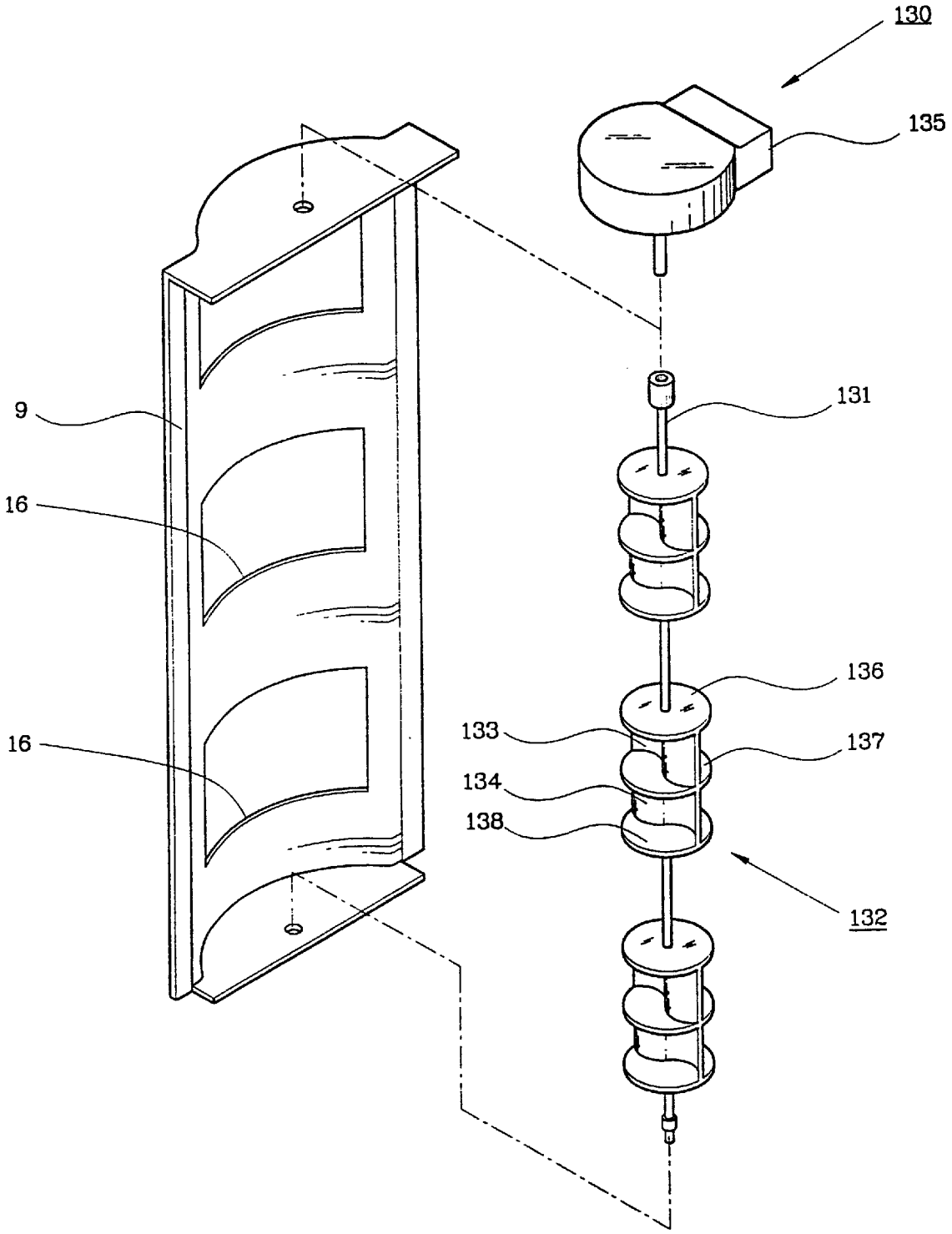
FIG. 3 (PRIOR ART)
FIG. 3 is an enlarged exploded perspective view of main elements of FIG. 2.

Hereinafter, the present invention will be described in detail with reference to the drawings. The same or similar parts with the parts shown in FIGS. 1 through 3 relating to the conventional art will be referred to with the same reference numerals. The description of the parts in each embodiment which are substantially the same with the pairs of the prior art will be omitted.

Figure 4:
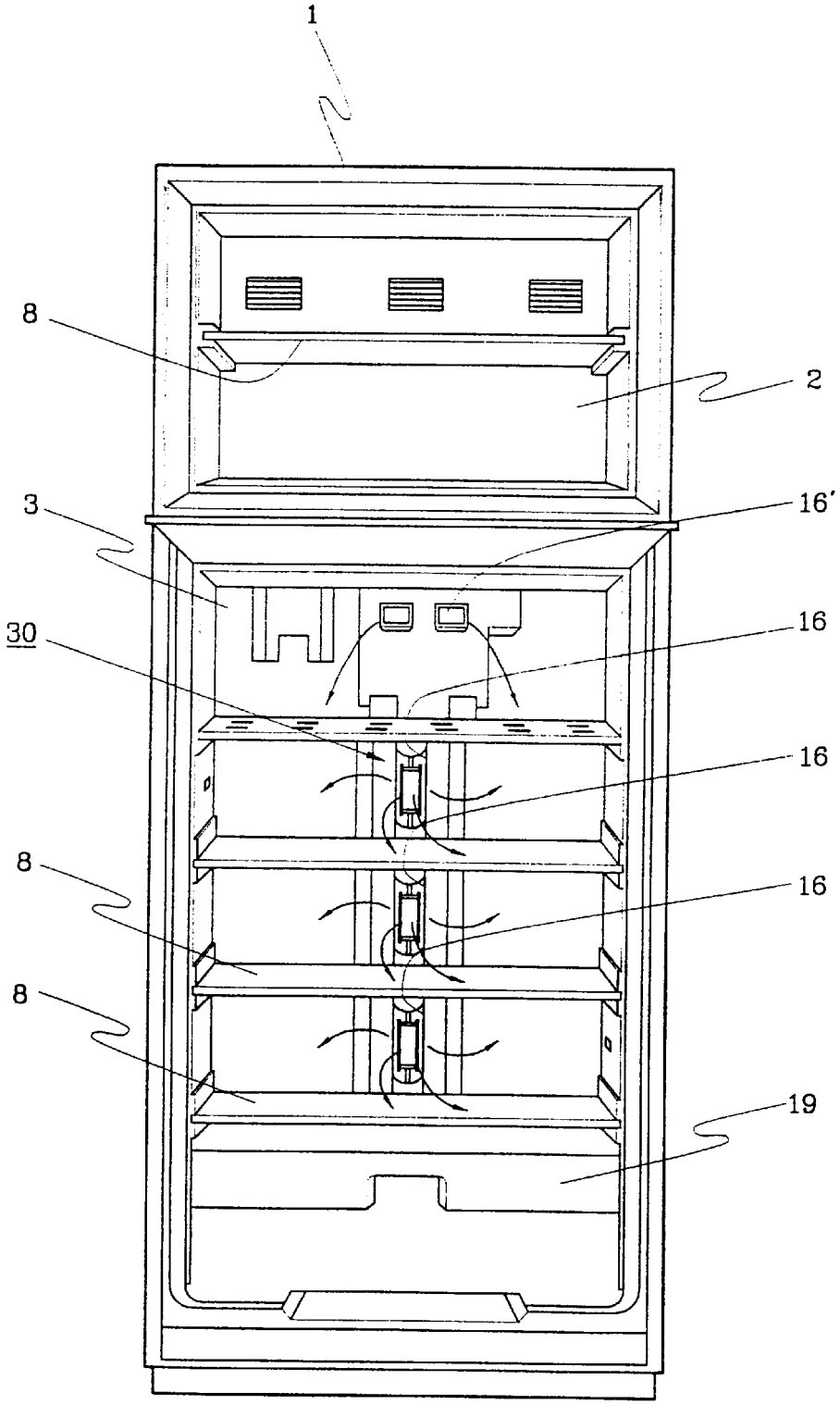
FIG. 4 is a front view of a refrigerator according to the first embodiment of the present invention.
Figure 5:
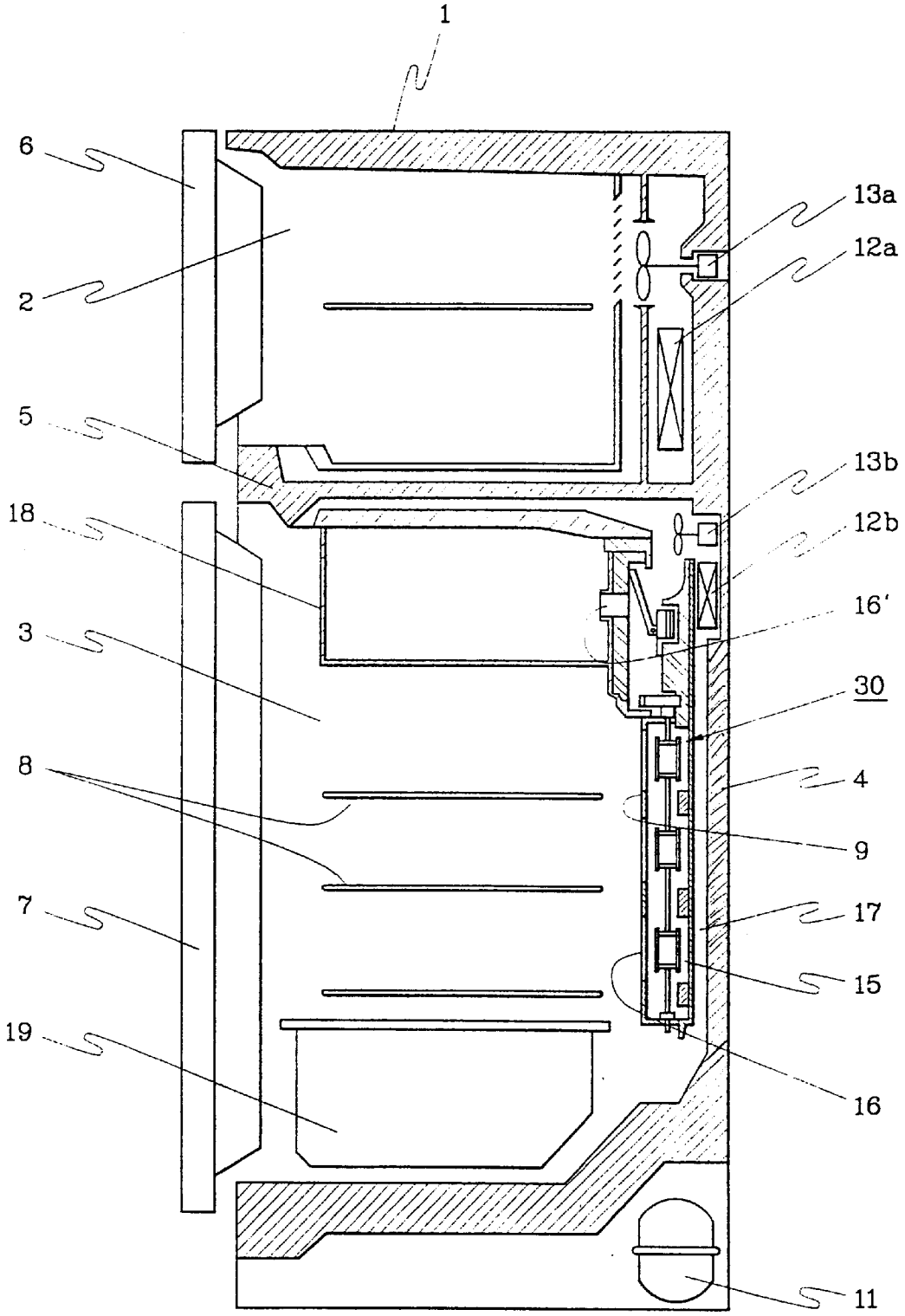
FIG. 5 is a side sectional view of FIG. 4.

FIGS. 4 and 5 are side sectional views of a refrigerator having a cool air dispersing device according to the first embodiment of the present invention. The refrigerator has, as the conventional refrigerator which has been illustrated with reference to FIGS. 1 through 3, a cabinet 1 forming freezing compartment 2 and a fresh food compartment which are partitioned by a partitioning wall 5 and are disposed upper and lower parts thereof, respectively. On the front openings of the freezing compartment 2 and the fresh food compartment 3, doors 6 and 7 for opening/closing them are installed respectively. In the fresh food compartment 3, shelves 8 for placing food thereon is installed, which divide the fresh food compartment 3 into three stratified area, i. e., an upper area, a middle area, and a lower area. A special fresh chamber 18 for storing food which are proper to a specific temperature range is formed at the upper part of the fresh food compartment 3, and a vegetable chamber 19 for storing vegetables is formed at the lower part of the fresh food compartment 3.

In the cabinet 1 is installed a cooling system comprising a compressor 11, a condenser (not shown), a freezing compartment evaporator 12*a*, and a fresh food compartment evaporator 12*b*. The cool air generated by the evaporators 12*a* and 12*b* is supplied into the corresponding cooling compartments 2 and 3 by the freezing compartment fan 13*a* and the fresh food compartment fan 13*b*.

A duct plate 9 is attached on the inner wall plate 23 forming, the rear inner wall of the fresh food compartment 3. The duct plate 9 is formed into a partial cylinder shape so as to protrude at the shape of an arc from the inner wall plate 23 toward the fresh food compartment 3, and has cool air discharge ports 16 opened toward the respective storing areas of the fresh food compartment 3. At the upper area of the inner wall plate 23 is provided another cool air discharge port 16' opened toward the special fresh chamber 18.

Between the duct plate 9 and the rear wall 4 of the cabinet 1, a supply duct 15 and a return duct 17 are provided, which are partitioned from each other by a seal plate 25. In the supply duct 15, a duct member 21 for guiding the cool air blown by the fresh food compartment fan 13*b* downwardly is installed. The cool air generated by the fresh food compartment evaporator 12*b* is blown by the fresh food compartment fan 13*b* so as to be supplied into the fresh food compartment 3 via the supply duct 15 and the cool air discharge ports 16. A device 30 for dispersing the cool air horizontally is installed in the supply duct 15.

Figure 6:
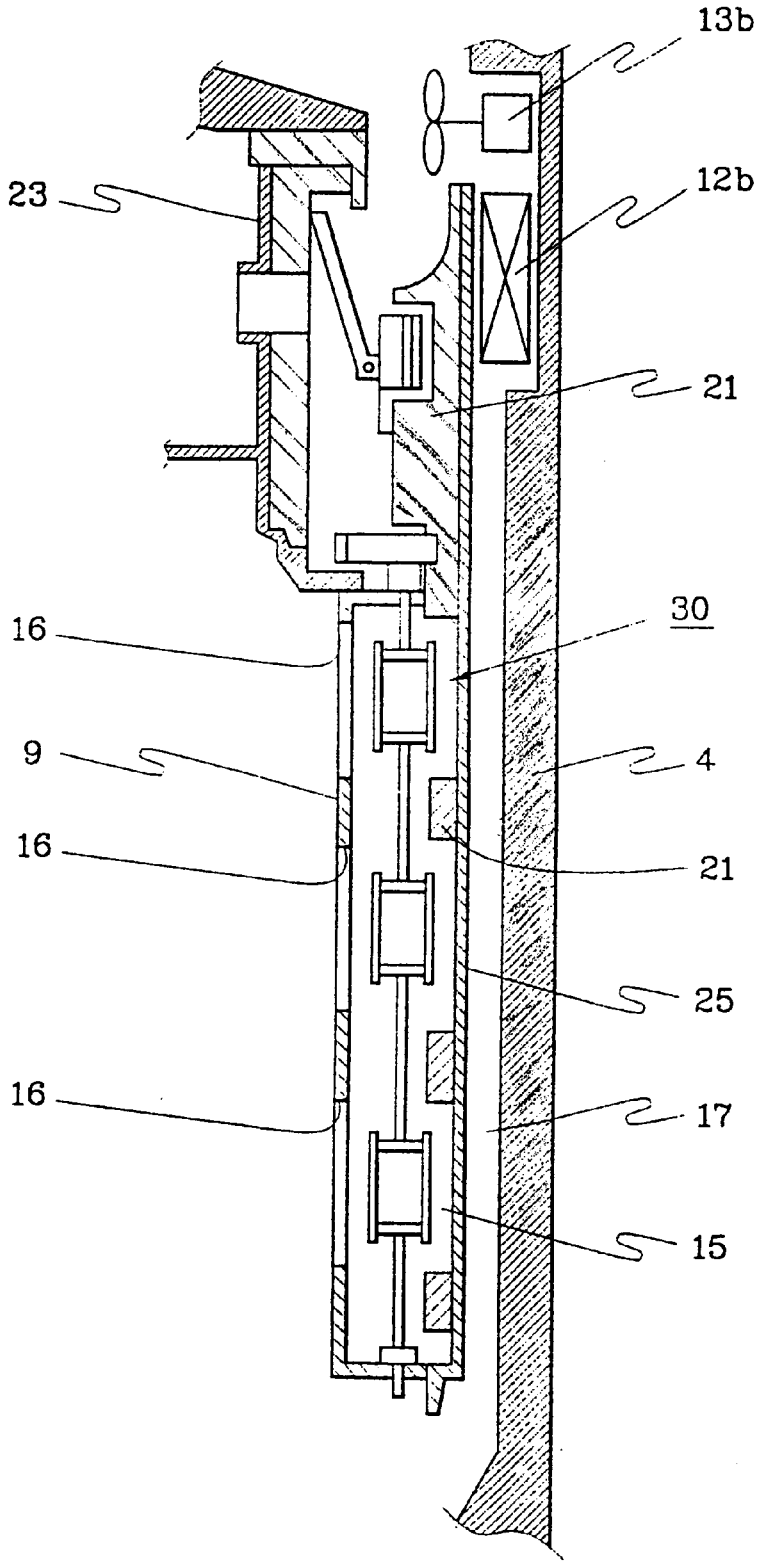
FIG. 6 is a partial enlarged sectional view of FIG. 5.
Figure 7:
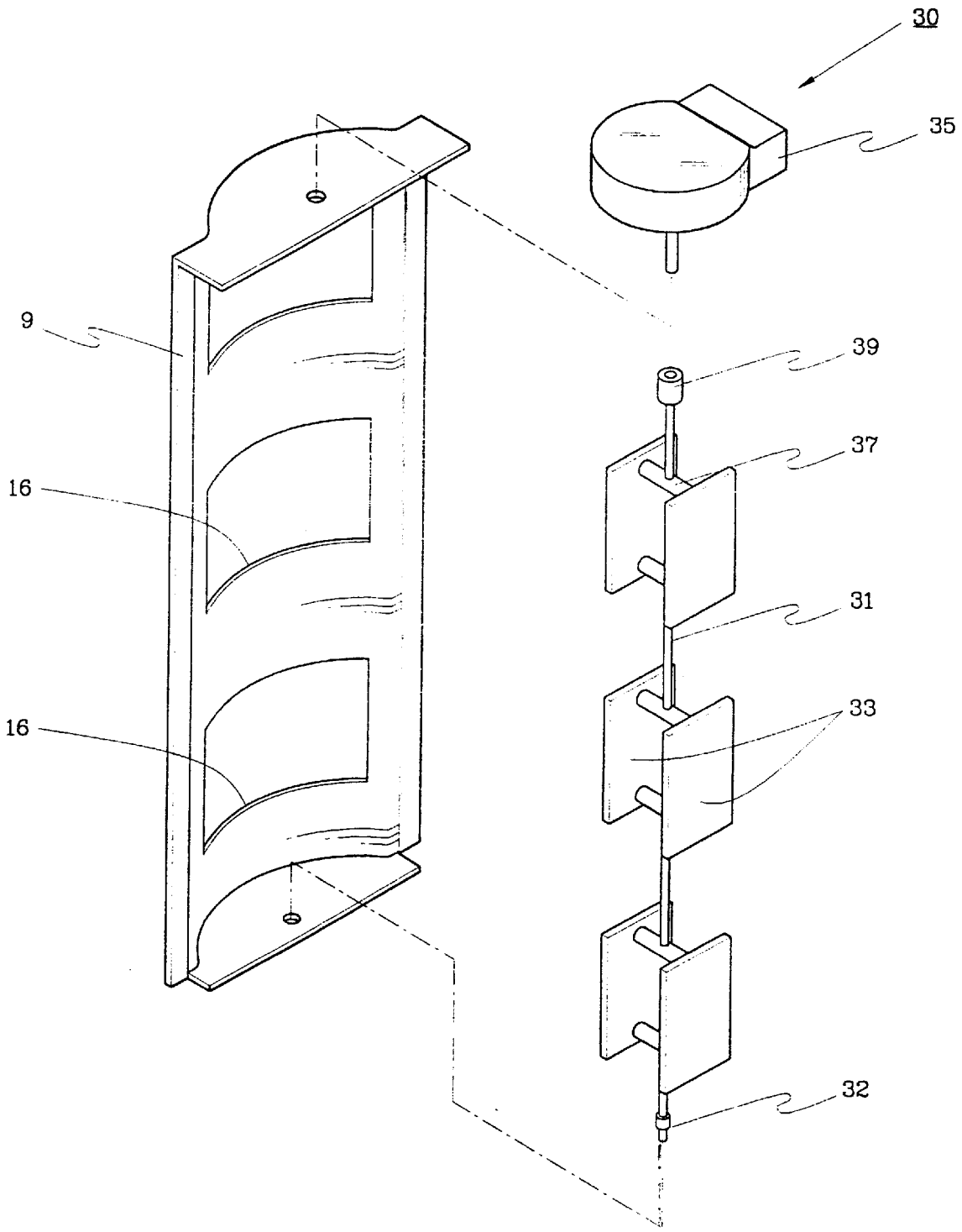
FIG. 7 is an enlarged exploded perspective view of main elements of FIG. 6.

FIGS. 6 and 7 are an enlarged sectional view and an exploded perspective view respectively, which show the area of the horizontal-dispersing device 30. The horizontal-dispersing, device 30 has a rotational shaft 31 having a vertical axis, three pairs of horizontal-dispersing blades 33 having the shape of a planar plate, and a driving motor 35 for rotating the rotational shaft 31. Three pairs of horizontal-dispersing blades 33 are disposed near the respective cool air discharge ports 16 formed on the duct plate 9 along an axis direction. The horizontal-dispersing blades 33 in each pair are disposed in parallel with each other at the opposite sides to each other with the rotational shaft 31 disposed therebetween, and are connected with each other by a connecting bar 37. The rotational shaft 31 is fixed to the connecting bars 37 in a body. A coupling part 39 for being coupled with a driving shaft of the driving motor 35 is provided at the upper end of the rotational shaft 31, and a journal part 32 supported rotatably by being inserted into a bearing hole formed at the lower area of the duct plate 9 is provided at the lower end of the rotational shaft 31. It is preferable that the driving motor 35 is a stepping motor which is capable of controlling angular stop position.

Then, when the driving motor 35 operates, the horizontal-dispersing blades 33 are rotated by the rotational shaft 31, and thereby the cool air discharged through the cool air discharge ports 16 is dispersed horizontally.

Figure 8:
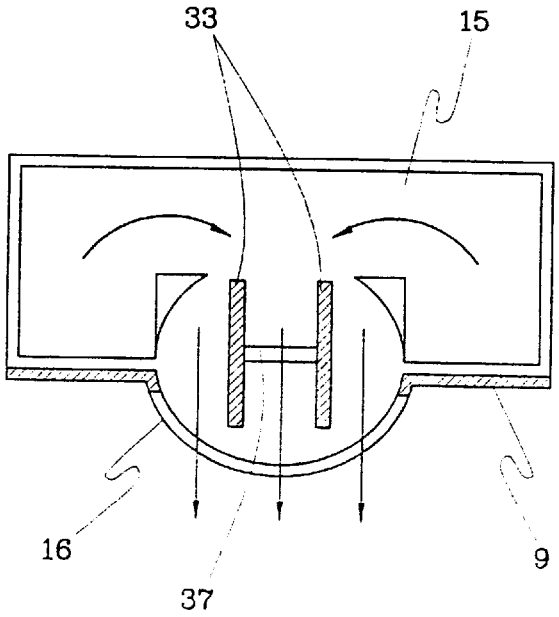
FIGS. 8 through 11 are enlarged sectional views showing, the cool air dispersing process performed by the horizontal-dispersing blades successively.
Figure 9:
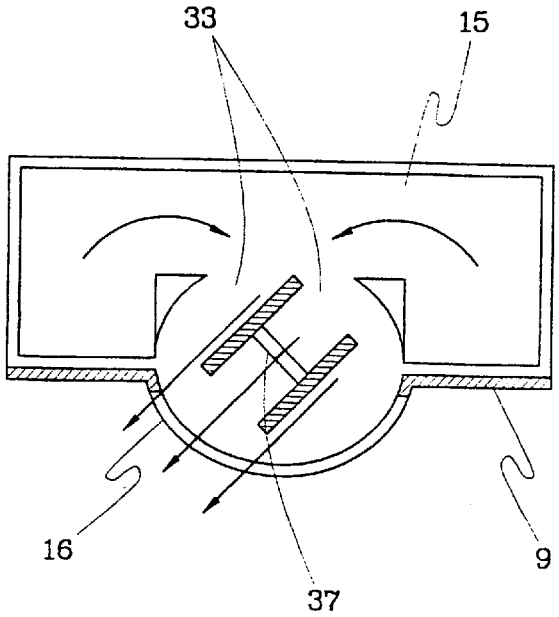
Figure 10:
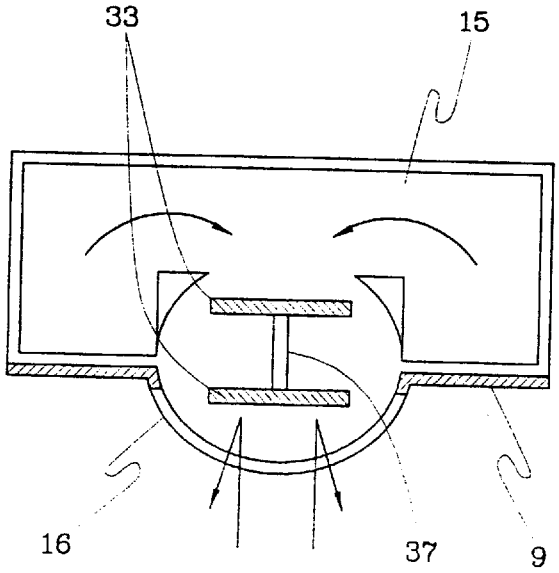
Figure 11:
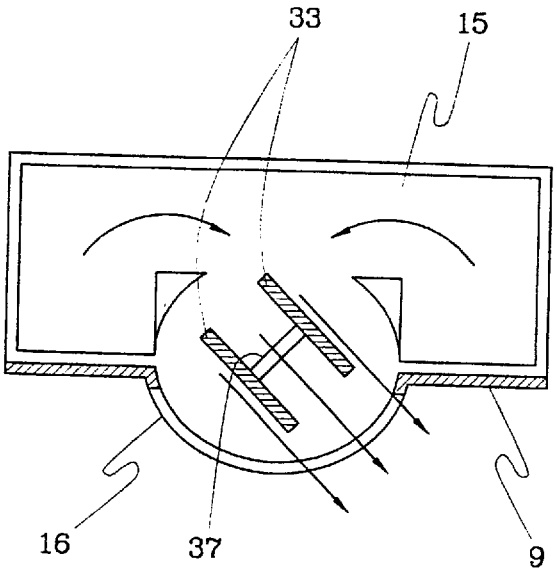

FIGS. 8 through 11 are transverse sectional views showing the discharging state of the cool air while the horizontal-dispersing blades 33 are rotating. As shown in the figures, the horizontal-dispersing blades 33 of the cool air dispersing device 30 rotate at 360 degrees as the driving motor 35 operates. When the horizontal-dispersing blades 33 are directed to the front side as shown in FIG. 8, the cool air in the supply duct 15 is discharged to the front side along the spaces between the horizontal-dispersing blades 33 and outer sides of the horizontal-dispersing blades 33. When the horizontal-dispersing blades 33 are directed transversely to the cool air discharge ports 16 as shown in FIG. 10, the discharge of the cool air toward the front side is blocked and cool air is discharged so as to be dispersed toward both left and right sides.

As described, the discharge direction of the cool air is consecutively changed as the angular position of the horizontal-dispersing blades 33 is changed, so the cool air is dispersed into the fresh food compartment 3 uniformly. Moreover, since the horizontal-dispersing blades 33 are formed into the shape of a planar plate, there is no vortex caused by the rotation of the horizontal-dispersing blades 33.

Furthermore, if the concentrative supply of the cool air on a specific area such as left side or right side is required, the concentrative cooling can be realized by stopping the driving motor 35 when the horizontal-dispersing blades 33 is directed to the corresponding area. In such a situation, temperature sensors placed at a plurality of positions in the fresh food compartment 3, as well as a control part for controlling the driving motor 35 on the basis of the sensing signal from the temperature sensors have to be provided.

Meanwhile, in the above-described embodiment, a pair of horizontal-dispersing, blades 33 are disposed in correspondence to each cool air discharge port 16, however, it is possible that only a pair of horizontal-dispersing blades are extended throughout all of the cool air discharge ports 16.

Figure 12:
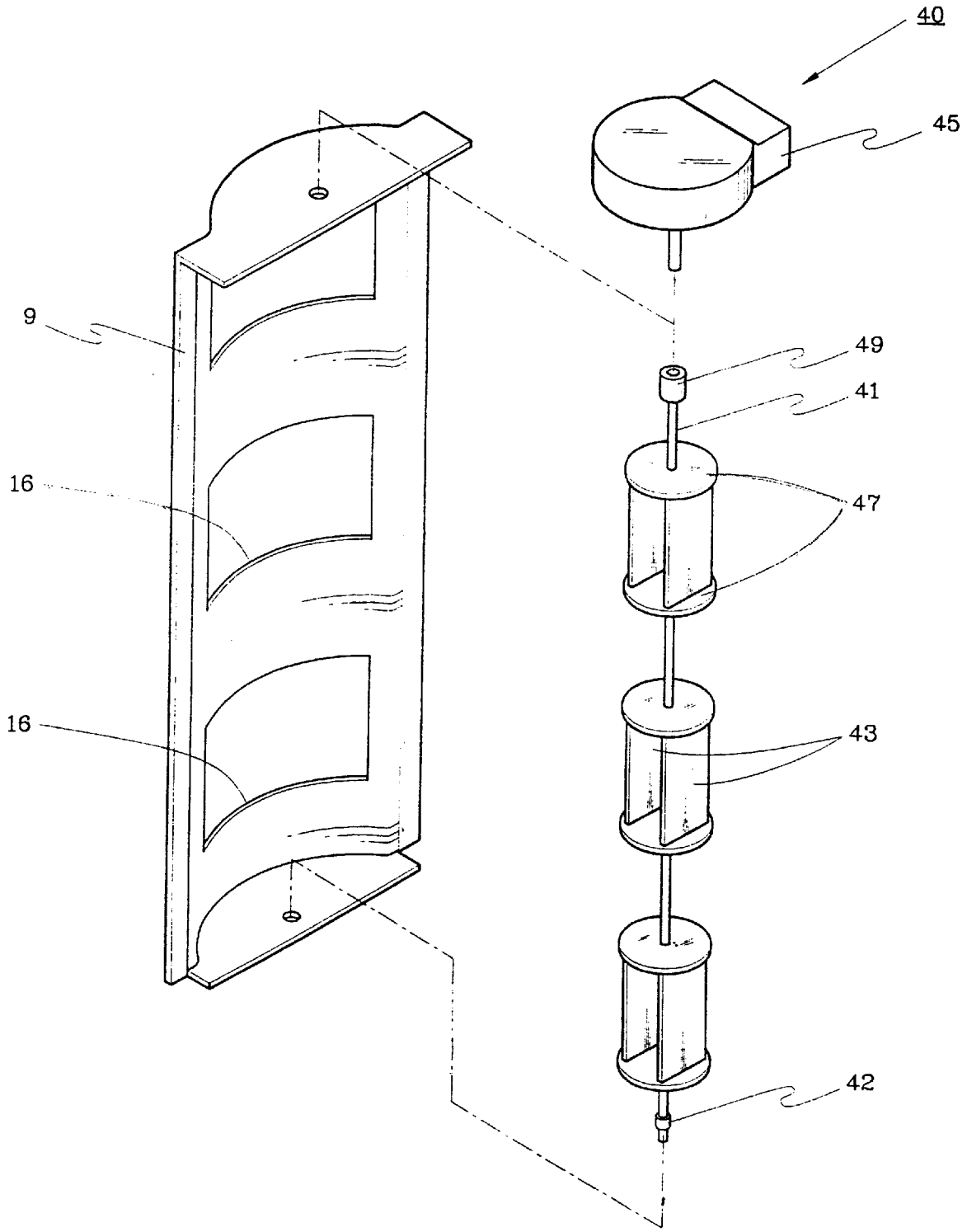
FIG. 12 is an enlarged exploded perspective view of main elements of the cool air dispersing, device according to the second embodiment of the present invention.

FIG. 12 is a perspective view of the cool air dispersing device 40 according to the second embodiment of the present invention. The cool air dispersing device 40 has substantially the same construction with the cool air dispersing device 30 according to the first embodiment, but both ends of the horizontal-dispersing, blades 43 of each pair are assembled in a body with each other by disc-shaped connecting plates 47. The rotational shaft 41 is coupled at the central part of the connecting plates 47. A coupling part 49 for connecting with the driving motor 45 is provided at the upper end of the rotational shaft 41, and a journal part 32 supported rotatably is provided at the lower end thereof.

In this embodiment, the connecting plates 47 function not only to connect the horizontal-dispersing, blades 43 with each other but also to guide the cool air so that the cool air flowing downward along the supply duct 15 strikes thereon and then is directed toward the cool air discharge ports 16.

Figure 13:
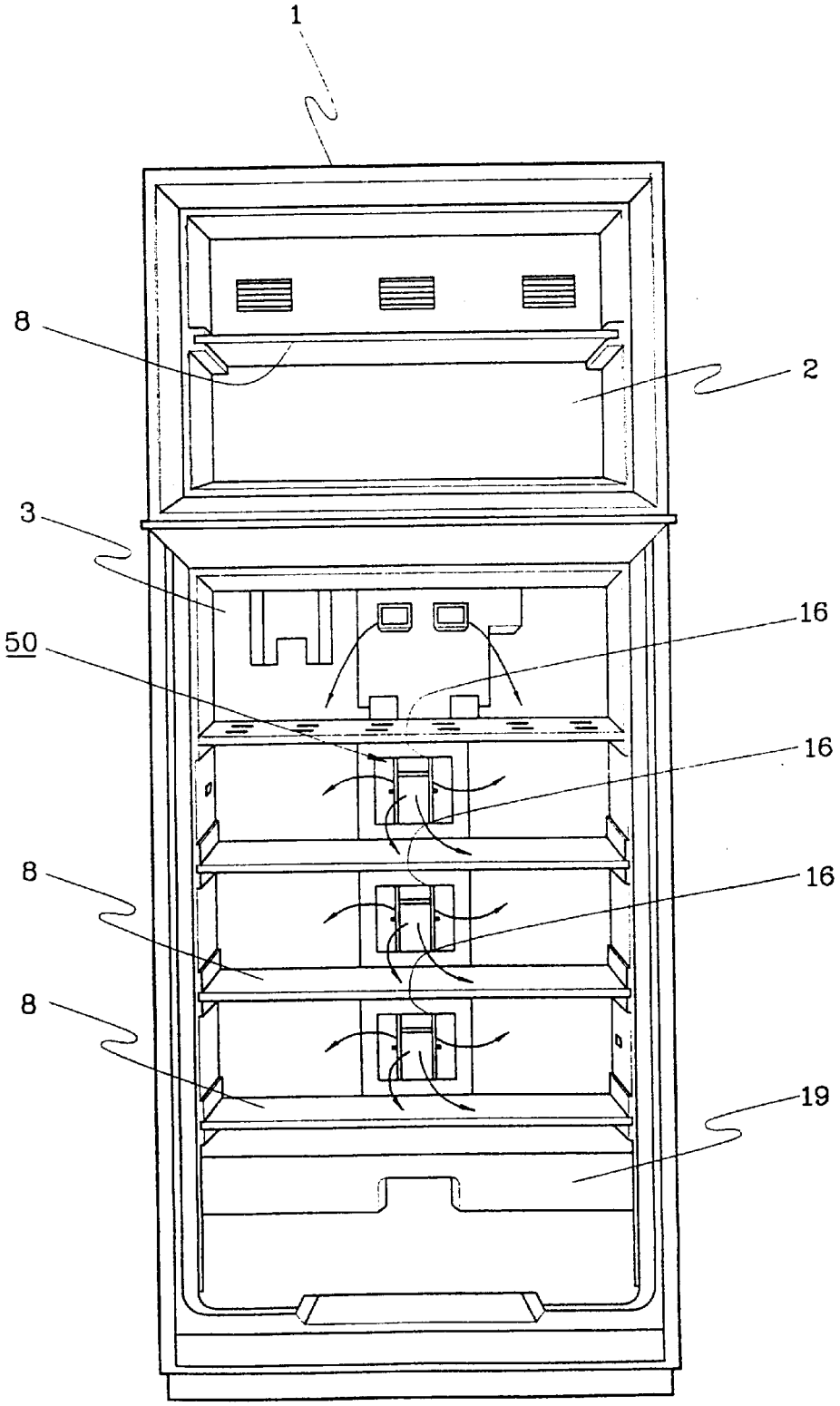
FIG. 13 is a front view of a refrigerator according to the third embodiment of the present invention.
Figure 14:
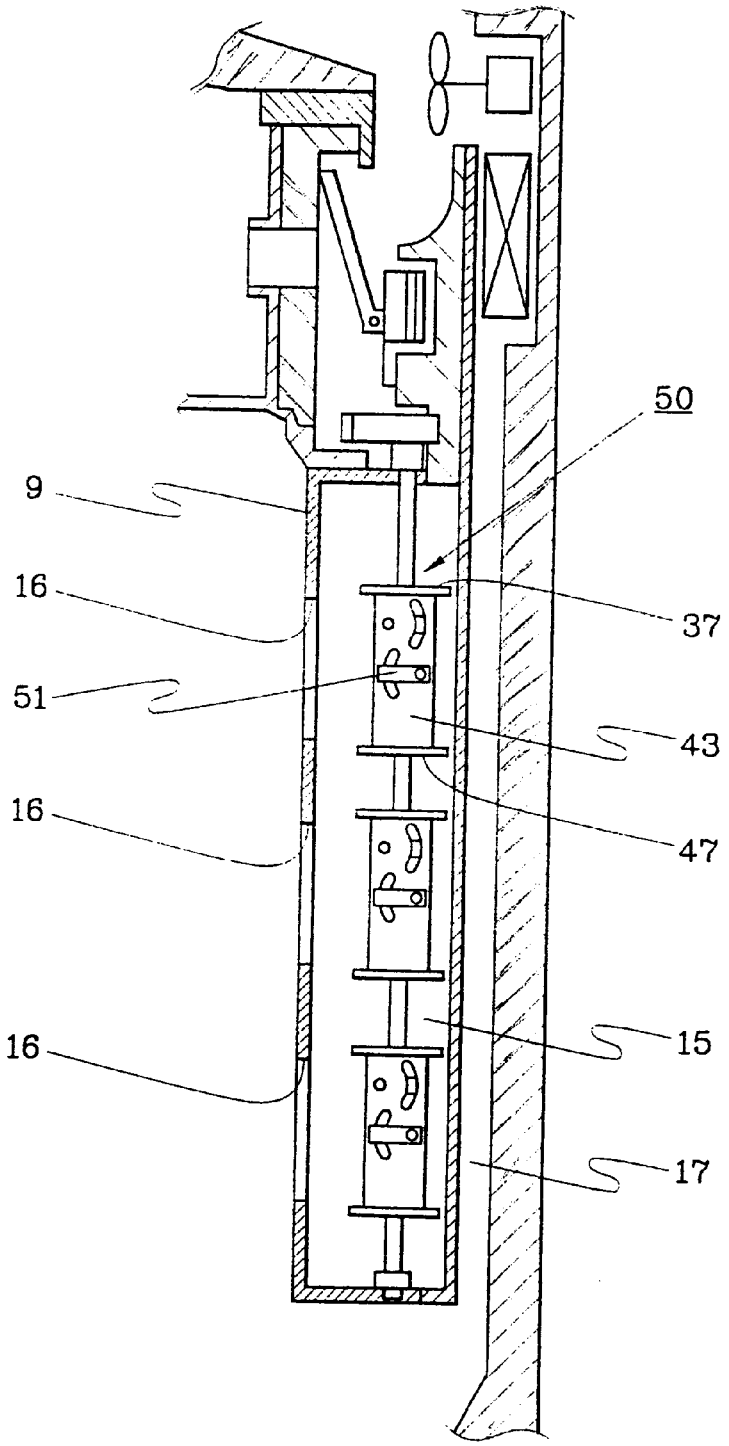
FIG. 14 is an enlarged side sectional view of main part of FIG. 13.
Figure 15:
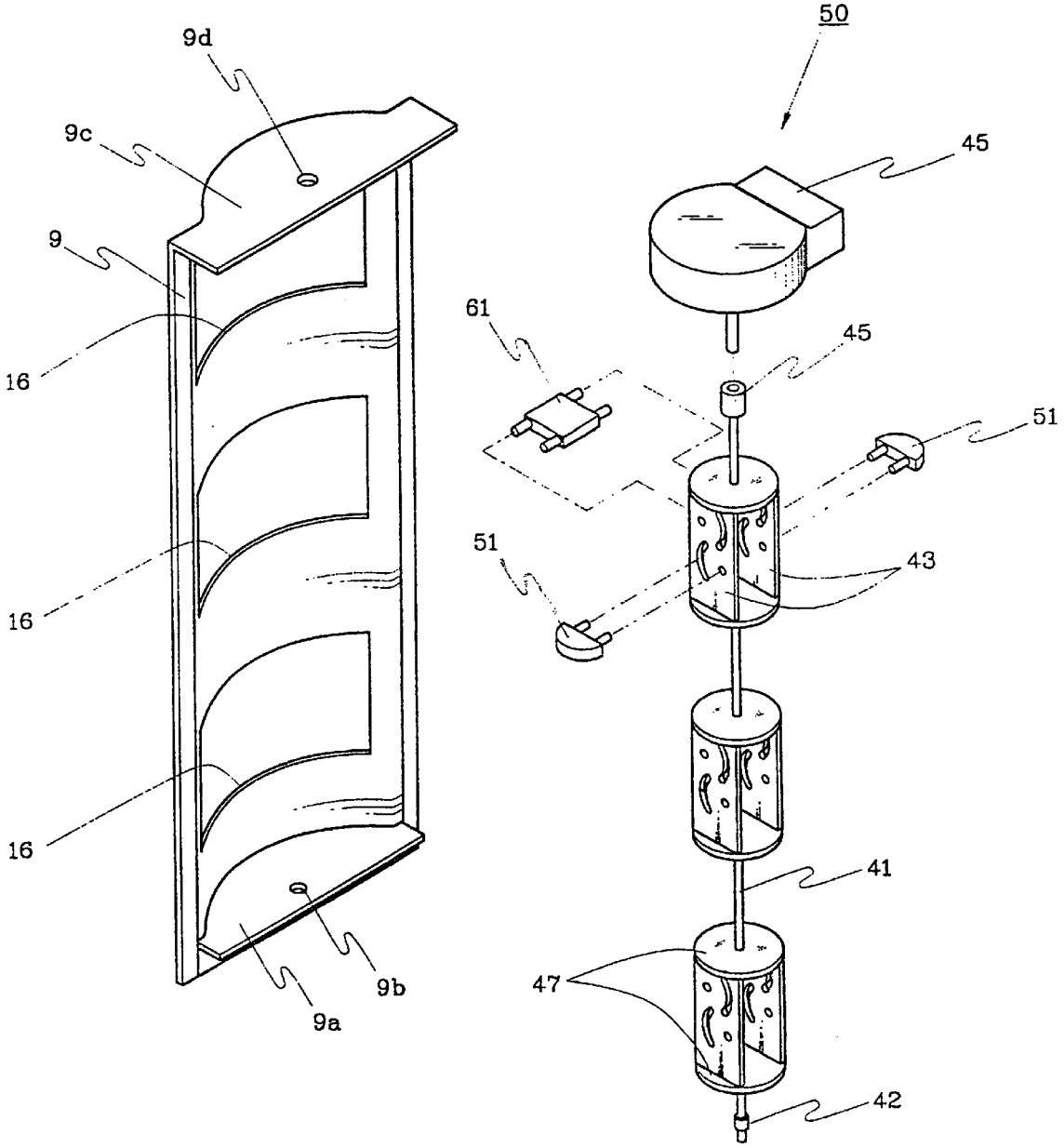
FIG. 15 is an enlarged exploded perspective view of main elements of FIG. 14.
Figure 16:
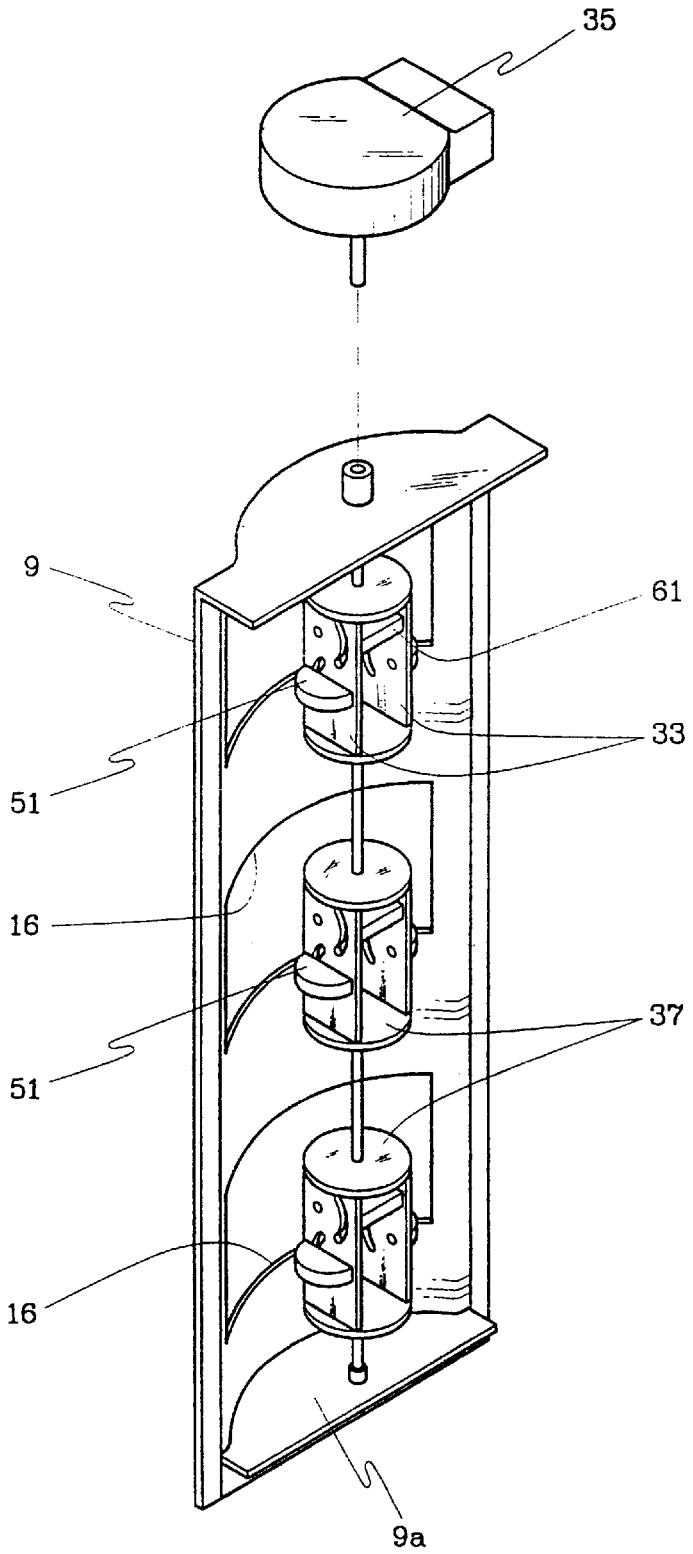
FIG. 16 is a perspective view showing the assembled state of FIG. 15.
Figure 17:
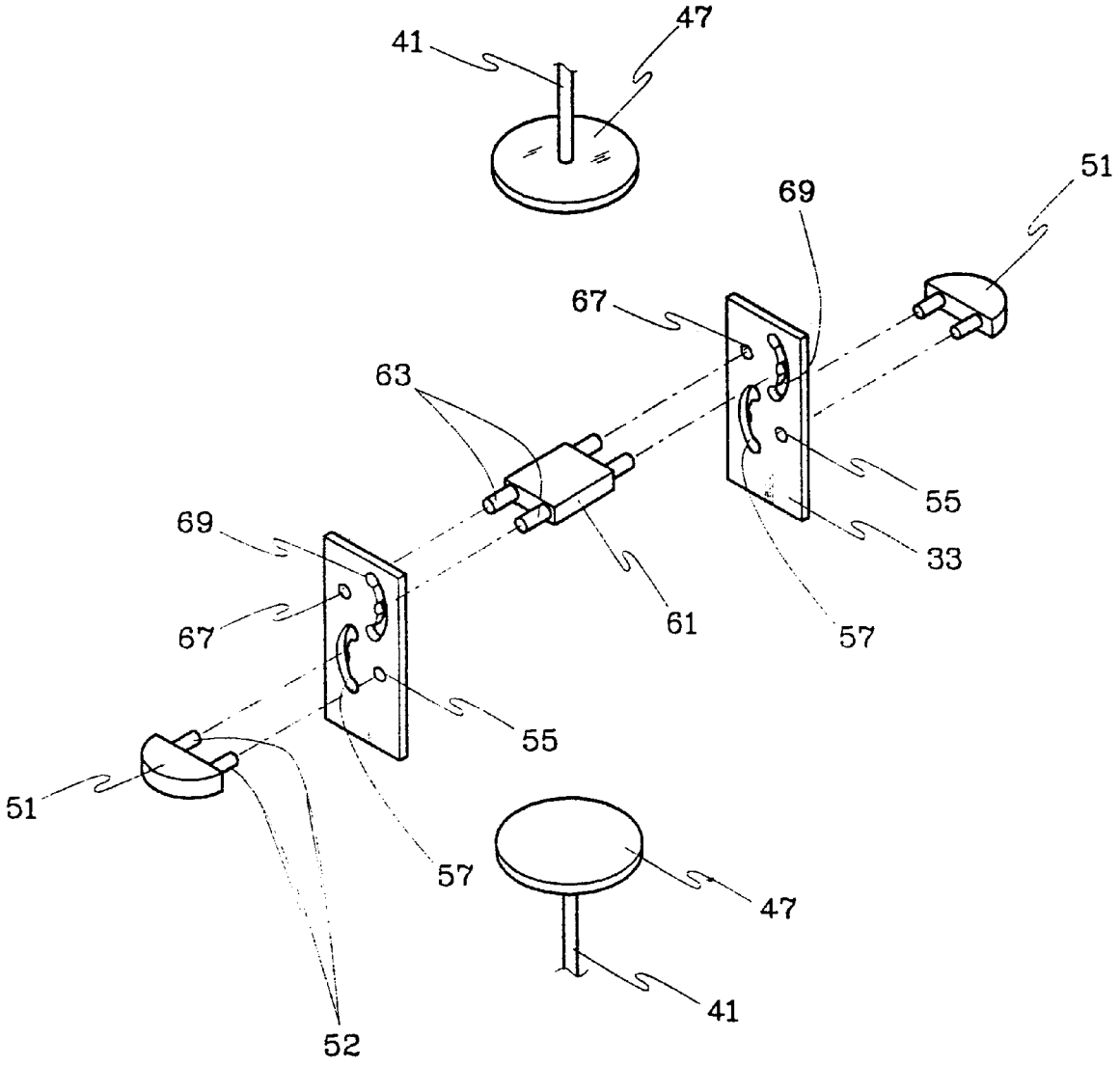
FIG. 17 is a partial enlarged exploded perspective view of FIG. 15.

FIG. 13 is a front view of the refrigerator having the cool air dispersing device according to the third embodiment of the present invention, FIG. 14 is an enlarged side sectional view of main part thereof, FIGS. 15 and 16 are enlarged exploded perspective view and perspective view showing the main elements, and FIG. 17 is a partial enlarged exploded perspective view thereof. As shown in FIG. 13, the refrigerator in the present embodiment is substantially the same with that of the aforementioned first embodiment except the construction of the cool air dispersing device 50.

The cool air dispersing device 50 has, as the horizontal-dispersing device 40 according to the second embodiment shown in FIG. 12 a rotational shaft 41, horizontal-dispersing blades 43, connecting plates 47, and a driving motor 45. It also has a coupling part 49 for coupling axially with the driving motor 45 at the upper end thereof, and a journal part 42 for the rotational support at the lower end thereof. The duct plate 9 has a lower support part 9*a* and an upper support part 9*c* which are horizontally extended at the upper and lower ends thereof. The lower support part 9*a* is formed with a bearing hole 9*b* for receiving the journal part 42, and the upper support part 9*c* is formed with another bearing hole 9*d* for receiving the upper end of the rotational shaft 41 to be capable of rotating.

Unlike the second embodiment, the present embodiment further comprises outer auxiliary blades 51 attached to the outer surface of respective horizontal-dispersing blades 43, and a central auxiliary blade 61 disposed between both of the horizontal-dispersing blades 43. The outer auxiliary blade 51 is formed into the shape of a semi-disc and is attached to the surface of the horizontal-dispersing blades 43 so as to be orthogonal thereto, and the central auxiliary blade 61 is formed into the shape of a rectangular plate and is disposed between both of the horizontal-dispersing blades 43 to be transverse thereto.

The outer auxiliary blade 51 is formed with a pair of installation pins 52 protruding toward the horizontal-dispersing blade 43. Both of the installation pins 52 are spaced from each other, and the horizontal-dispersing blade 43 is formed with a fixing hole 55 having the shape of a circle and another fixing hole 57 having the shape of a long hole. The circular fixing hole 55 form-fittingly receives one of the installation pins 52, and the long fixing hole 57 is extended to form an arc about the circular fixing hole 55. If the outer auxiliary blade 51 is operated to pivot about the circular fixing hole 55 while the installation pins 52 of the outer auxiliary blade 51 is inserted into both fixing holes 55 and 57, the tilt of the outer auxiliary blade 51 can be regulated.

The central auxiliary blade 61 also has a pair of installation pins 63 protruding, toward the horizontal-dispersing blade 43 at each side end thereof, and the horizontal-dispersing blade 43 is formed with a fixing hole 67 having the shape of a circle and another fixing hole 69 having the shape of a long hole, into which the installation pins 63 are inserted respectively. The circular fixing hole 67 form-fittingly receives one of the installation pins 63, and the long fixing hole 69 is extended to form an arc about the circular fixing hole 67. If the central auxiliary blade 61 is operated to pivot about the circular fixing hole 67 while the installation pins 63 of the central auxiliary blade 61 is inserted into both fixing holes 67 and 69, the tilt of the central auxiliary blade 61 can be regulated.

Both of the auxiliary blades 51 and 61 function to guide the cool air so that the cool air flowing downward along the supply duct 15 is discharged through the cool air discharge ports 16 so as to be dispersed vertically. By regulating the tilt of the auxiliary blades 51 and 61, the uniform distribution of the cool air in vertical direction can be promoted. Therefore, the uniform distribution of the cool air in vertical direction can be achieved a little along with the uniform distribution thereof in horizontal direction achieved by the horizontal-dispersing blades 43.

Figure 18:
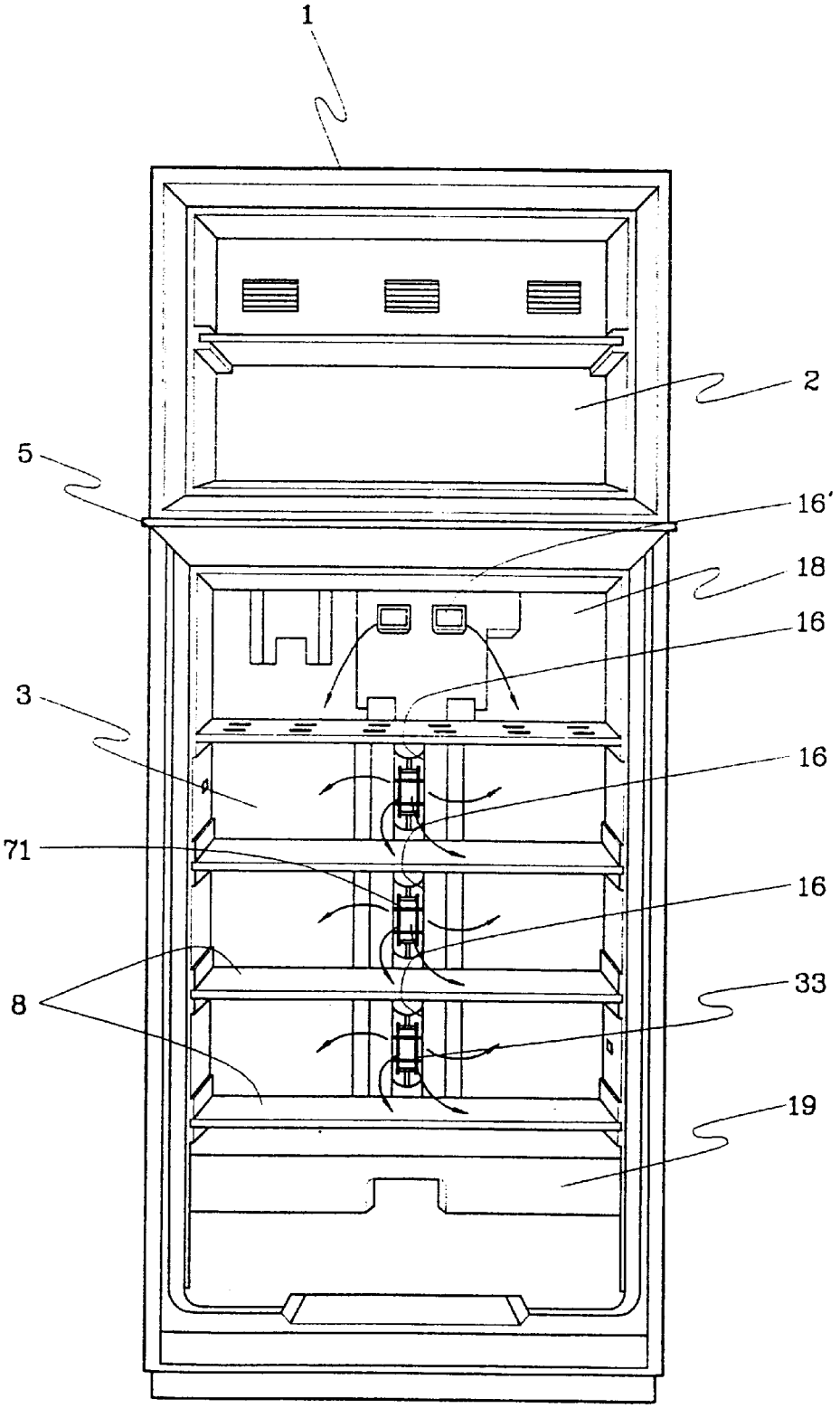
FIG. 18 is a front view of a refrigerator according to the fourth embodiment of the present invention.
Figure 19:
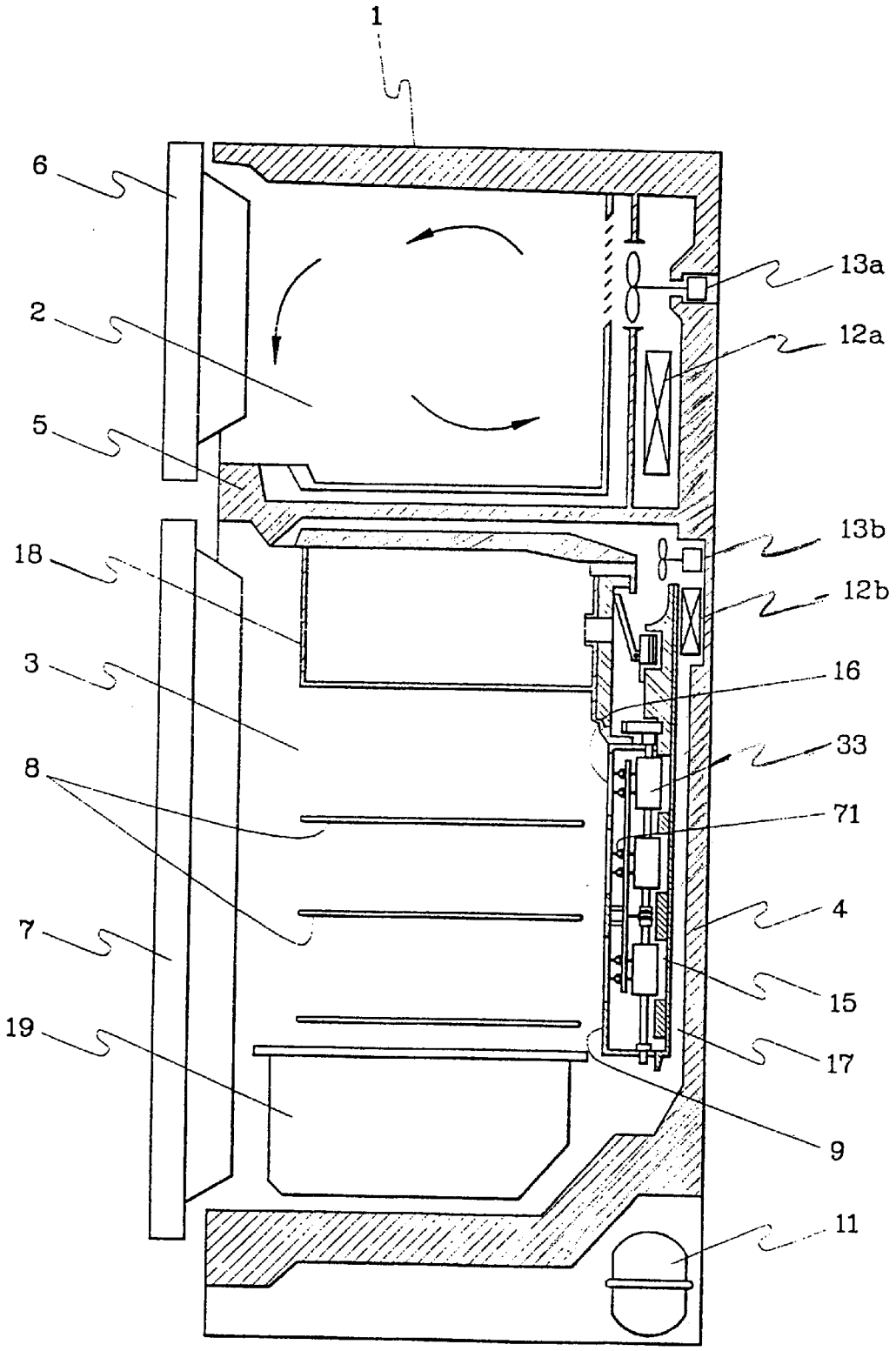
FIG. 19 is a side sectional view of FIG. 18.
Figure 20:
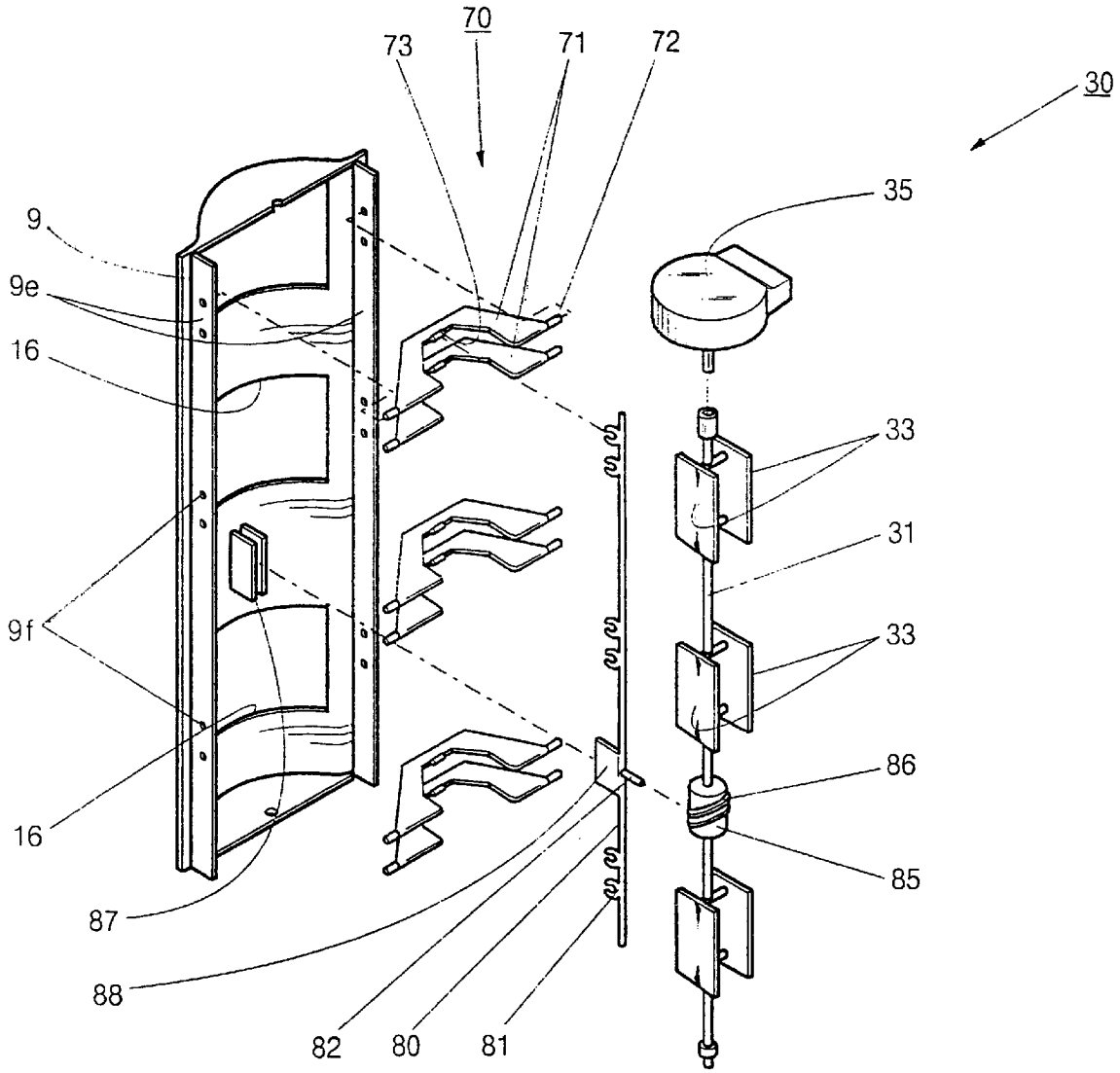
FIG. 20 is an enlarged exploded perspective view of main elements of FIG. 19.
Figure 21:
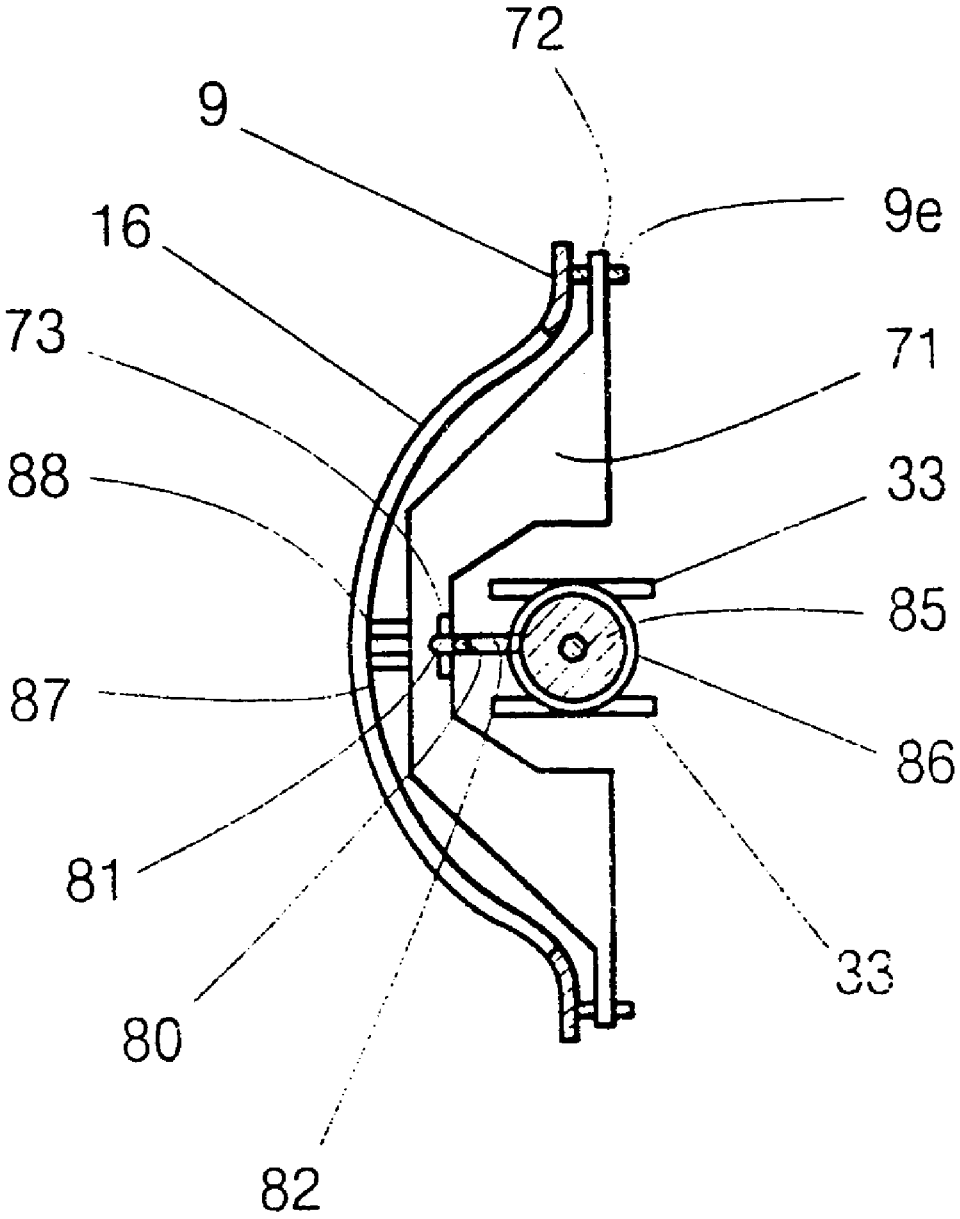
FIG. 21 is an enlarged transverse sectional view of the assembled state of FIG. 20.

FIG. 18 is a front view of a refrigerator according to the fourth embodiment of the present invention, FIG. 19 is a side sectional view of FIG. 18, FIG. 20 is an enlarged exploded perspective view of main elements of FIG. 19, and FIG. 21 is an enlarged transverse sectional view of the assembled state of FIG. 20. As shown in the figures, the refrigerator in the present embodiment has substantially the same construction with that of the first embodiment. But in the present embodiment, two vertical-dispersing blades 71 are appended to each of the horizontal-dispersing blade 33 shown in the first embodiment. The constitution and the function of the horizontal-dispersing device 30 are the same with those of the first embodiment, so the description of the same is not repeated.

In this embodiment, the refrigerator has a plurality of vertical-dispersing blades 71 corresponding to each of the cool air discharge ports 16, and hereinafter the set of the vertical-dispersing blades 71 will be called a vertical-dispersing blade set 70.

The vertical-dispersing blade 71 is formed into an arc plate so as to accommodate the horizontal-dispersing blades 33, and a horizontal rotational shaft 72 is extended along a horizontal axis thereof at the left and right ends thereof. In correspondence with it, the duct plate 9 is formed with flange parts 9*e* which are extended backward from the rear surface of both side edges thereof and are facing to each other, and the flange parts 9*e* are formed with a plurality of shaft holes 9*f* for receiving and rotatably supporting the horizontal rotational shaft 72. The vertical-dispersing blades 71 are capable of pivoting in the cool air discharge ports 16 while the horizontal rotational shaft 72 thereof is inserted into the shaft holes 9*f*.

Between the vertical-dispersing blade set 70 and the horizontal-dispersing, device 30 is disposed a link member 80 which is parallel with the rotational shaft 31. The link member 80 is formed into the shape of a rod, and has a plurality of hinge assembly parts 81 which have the shape of a partial ring and protrude toward the vertical-dispersing blades 71. In correspondence to the hinge assembly parts 81, each of the vertical-dispersing blades 71 has a hinge part 73 at the inner central area thereof, which is formed into a cylinder disposed along the horizontal direction. The hinge assembly parts 81 are engaged with the hinge parts 73 to be capable of rotating relatively thereto.

Also, an elevation/de-elevation cam 85 having a cylindrical surface is provided at the rotational shaft 31 of the horizontal-dispersing, device 30. A cam groove 86 is formed at the outer surface of the elevation/de-elevation cam 85, which is a closed loop having an elevational/de-elevational cam profile along the cylindrical surface. On the link member 80 is provided an operation part 82 protruding transversely to the longitudinal direction thereof, and the free end of the operation part 82 is inserted into the cam groove 86 of the elevation/de-elevation cam 85.

Furthermore, the link member80 has a guiding piece 88 protruding toward the duct plate 9, and the guiding piece 88 is accommodated in the elevation/de-elevation guiding part 87 formed on the inner wall of the duct plate 9. The elevation/de-elevation guiding part 87 accommodates the guiding piece 88 to be capable of guiding it up and down and preventing the link member 80 from rotating with respect to the axis thereof.

Having such a construction, when the horizontal-dispersing device 30 operates to rotate the rotational shaft 31, the elevation/de-elevation cam 85 rotates together therewith, and the link member 80 is elevated/de-elevated by the operation part 82 engaged with the cam groove 86 of the elevation/de-elevation cam 85. The elevational and de-elevational movement of the link member 80 causes the pivoting of the vertical-dispersing blades 71 with respect to the horizontal rotational shaft 72 through the hinge assembly part 81 and the hinge part 73 of the vertical-dispersing blades 71.

Figure 22:
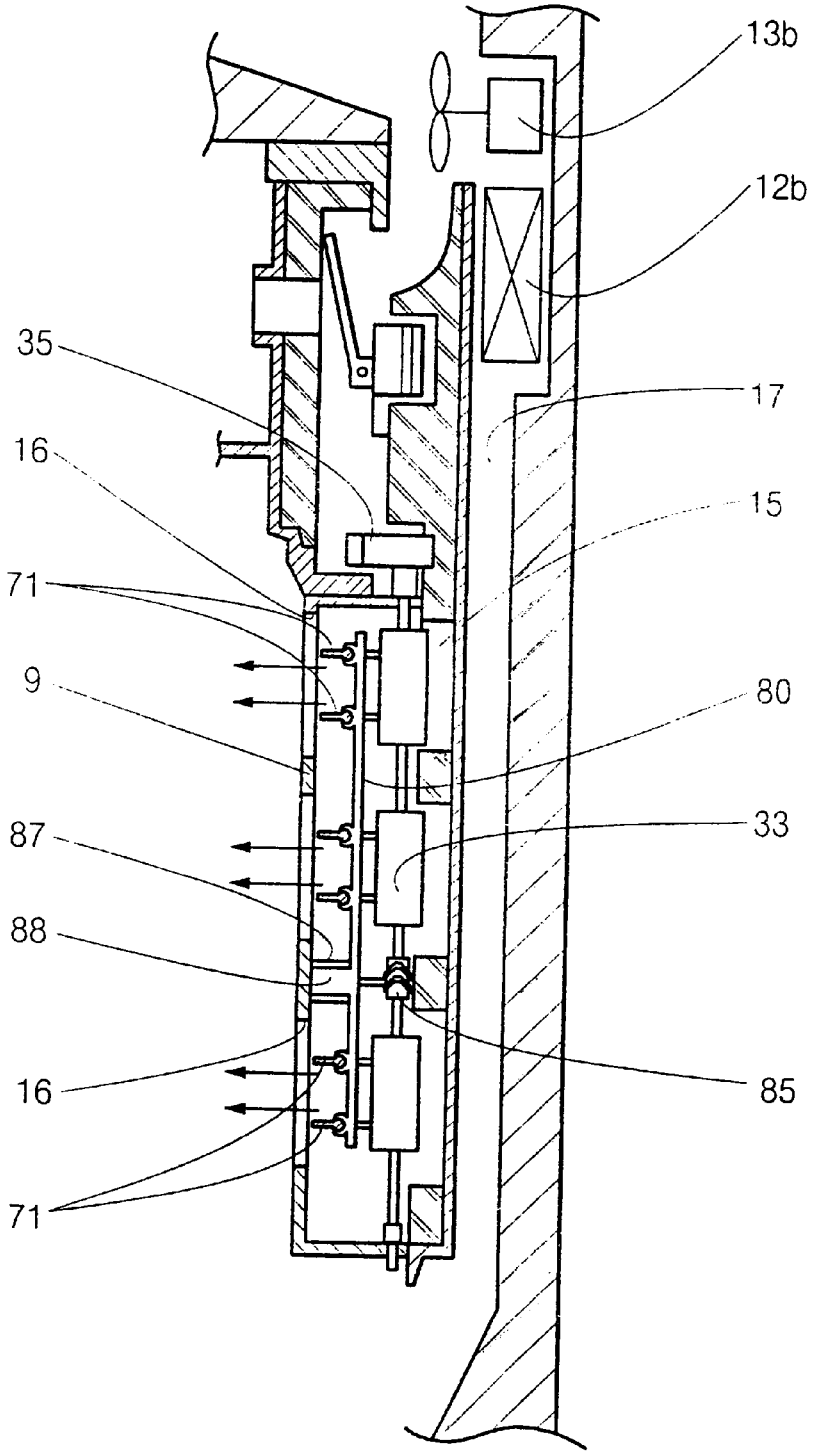
FIGS. 22 through 24 are side sectional views showing the operation successively.
Figure 23:
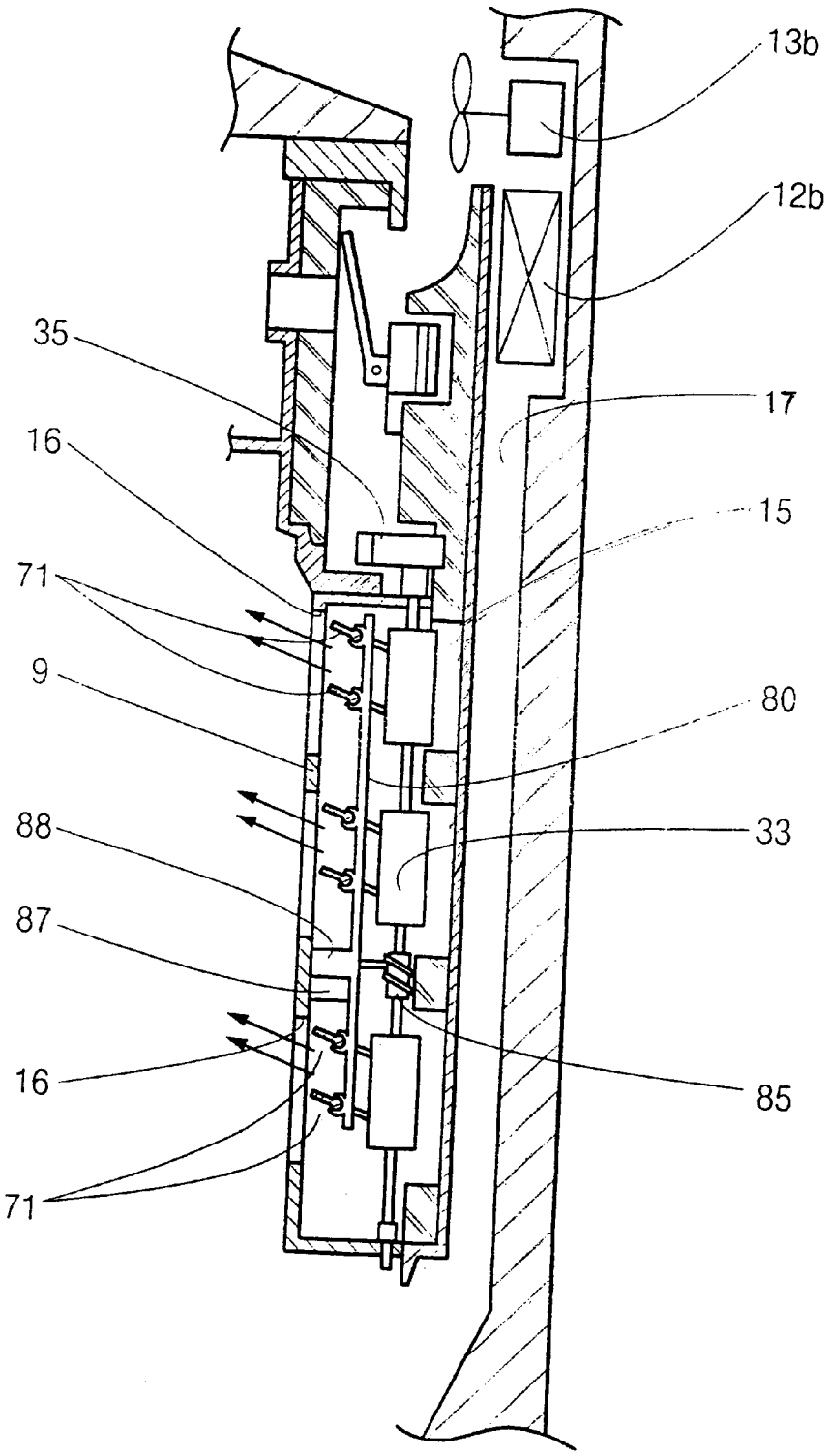
Figure 24:
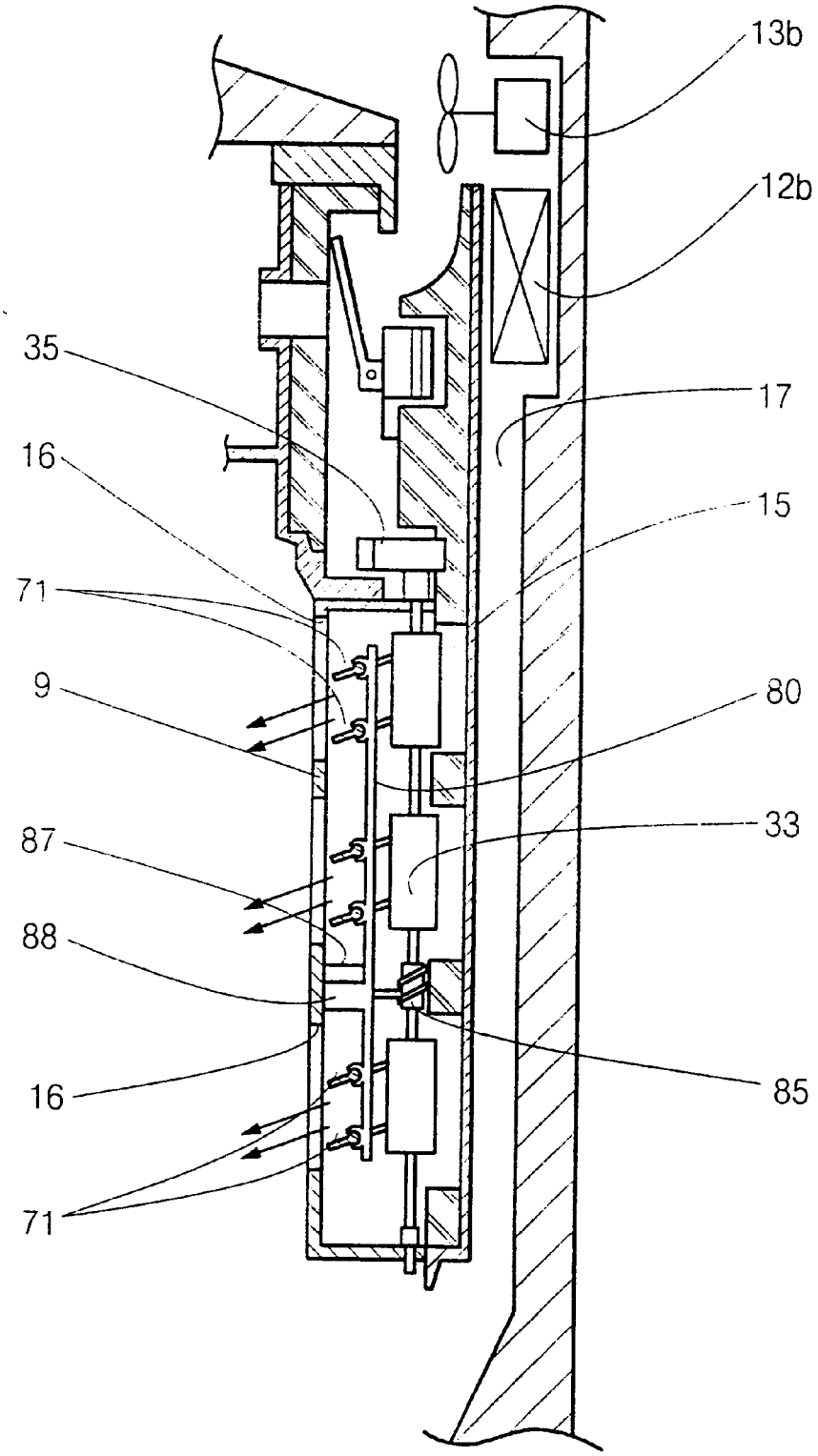

FIGS. 22 and 23 are side sectional views showing the elevational/de-elevational movement of the vertical-dispersing blades 71 caused by the rotation of the rotational shaft 31. As shown in FIG. 22, while the vertical-dispersing blades 71 are kept horizontal, the cool air is discharged horizontally. When the rotational shaft 31 rotates at about 90 degrees, the vertical-dispersing blades 71 are tilted upward as shown in FIG. 23, and in such a situation, the cool air is discharged upward to be supplied into the upper area of the fresh food compartment 3. As the rotational shaft 31 further rotates at about 90 degrees from the position shown in FIG. 23, the vertical-dispersing blades 71 is returned to the horizontal state as shown in FIG. 22, and as it further rotates at about 90 degrees, the vertical-dispersing blades 71 is tilted downward as shown in FIG. 24. In such a situation, the cool air is discharged downward.

As the above-described operations are repeated, the cool air is supplied uniformly alone the up-and-down direction, that is, along the vertical direction. During, such operations, since the horizontal-dispersing blades 33 also rotate, the cool air is dispersed uniformly along the horizontal direction.

Figure 25:
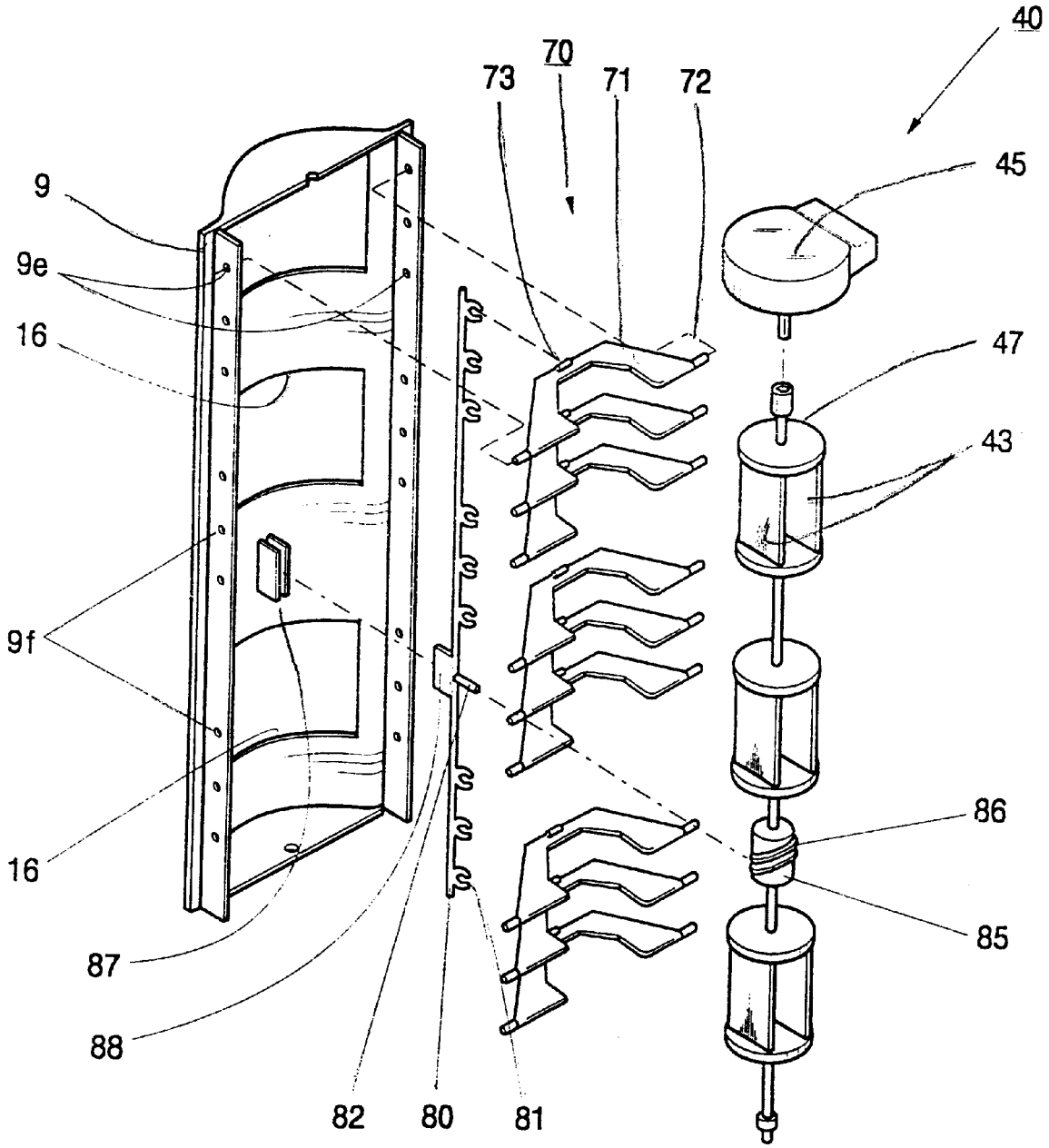
FIGS. 25 through 28 are figures showing the fifth embodiment of the present invention, which corresponds to FIGS. 20, 22, 23 and 24, respectively.

FIG. 25 is an exploded perspective view of the cool air dispersing device according to the fifth embodiment of the present invention, which corresponds to FIG. 20. The present embodiment has substantially the same construction with the fourth embodiment shown in FIG. 20, but adopting the horizontal-dispersing device 40 shown in FIG. 12 in substitution for the horizontal-dispersing device 30 shown in FIG. 7. Furthermore, three vertical-dispersing, blades 71 are appended to each of the cool air discharge ports 16.

Moreover, the link member 80 is disposed not between the vertical-dispersing blade set 70 and the horizontal-dispersing device 40 but between the duct plate 9 and the vertical-dispersing blade set 70. The construction of the other components, such as the elevation/de-elevation cam 85 for elevating/de-elevating, the link member 80, the cam groove 86, the operation part 82, and the hinge assembly parts 81, is substantially the same with that of the embodiment shown in FIG. 20, so the repeated description thereof is omitted.

In this embodiment, the connecting plate 47 for connecting both of the horizontal-dispersing blades 43 with each other functions to guide the cool air flowing downward through the supply duct 15 toward the cool air discharge ports 16. Furthermore, since the link member 80 is disposed between the duct plate 9 and the vertical-dispersing blade set 70, the vertical-dispersing blades 71 and the horizontal-dispersing blades 43 can be disposed to be further adjacent to each other. Therefore, the combinational effect for dispersing the cool air uniformly in the horizontal and vertical directions can be much more enhanced.

Figure 26:
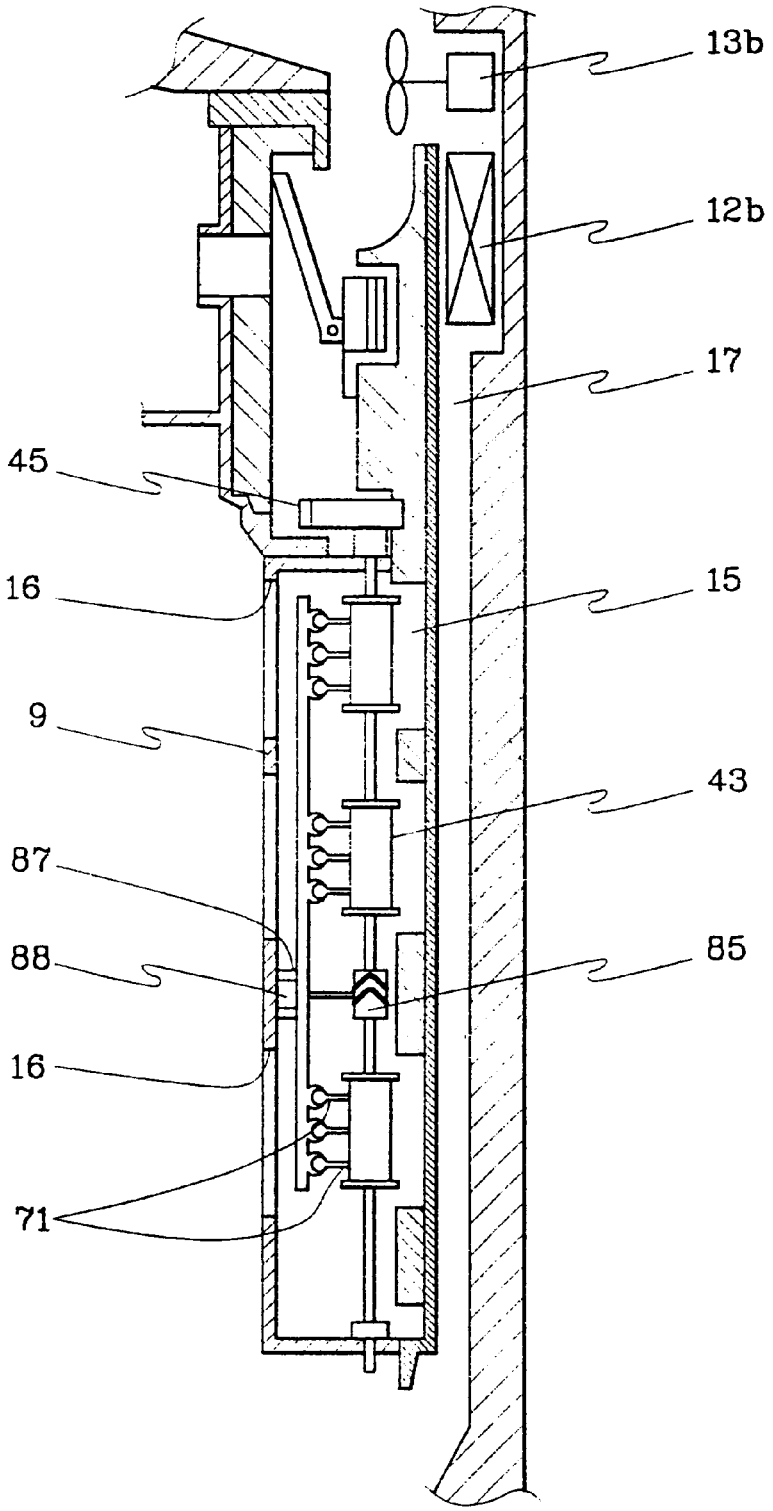
Figure 27:
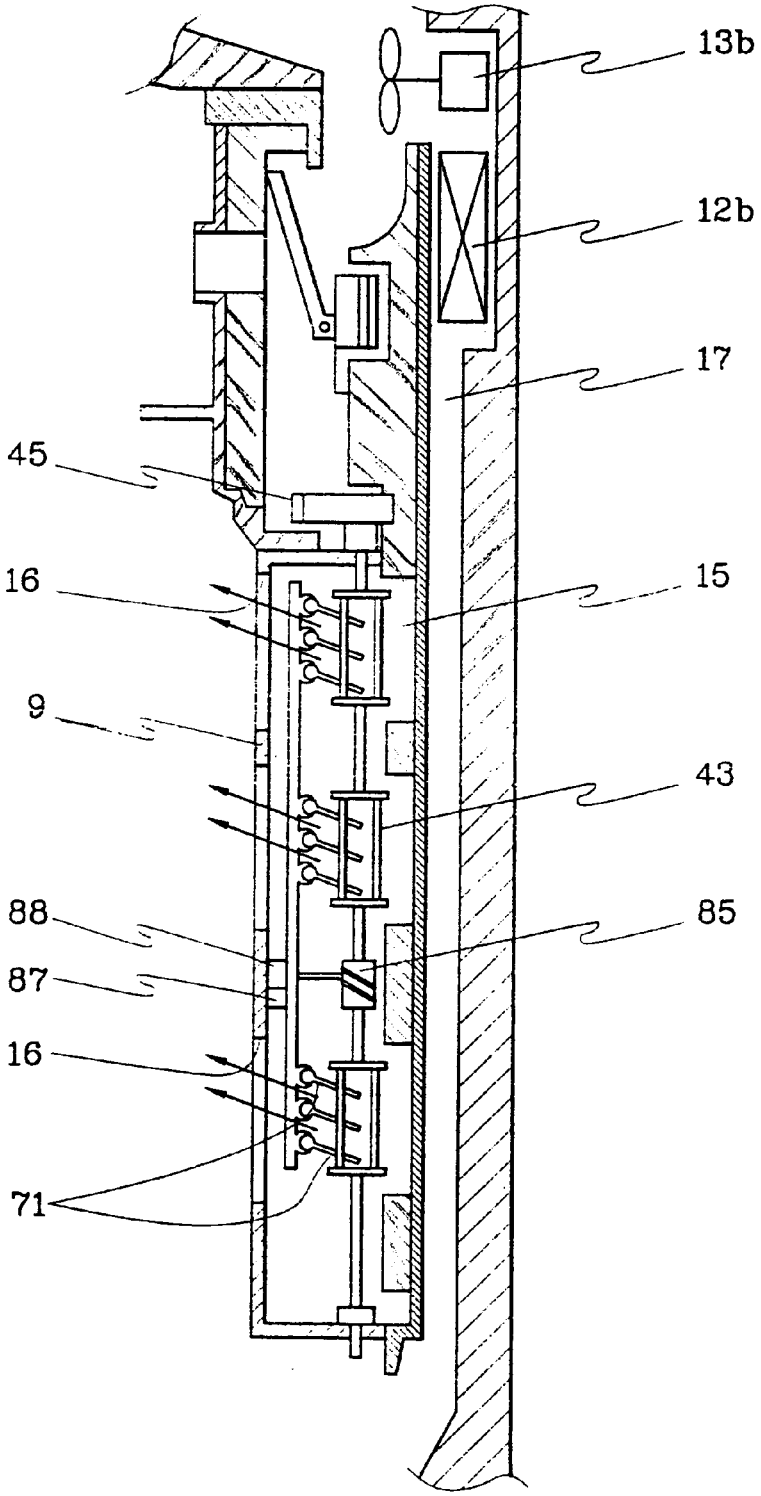
Figure 28:
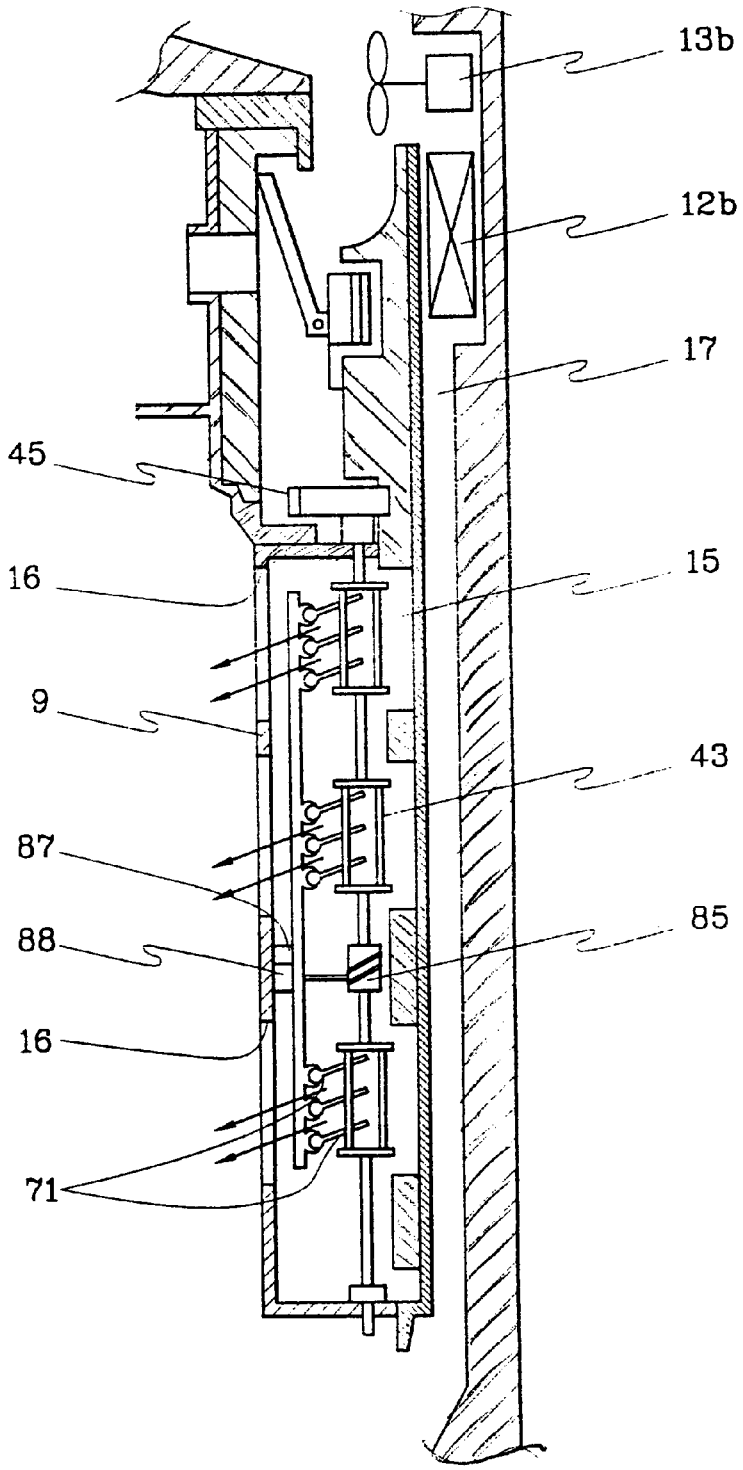

FIGS. 26 through 28 are side sectional views for illustrating the operation of the embodiment shown in FIG. 25. The rotation of the horizontal-dispersing blades 43, the pivoting of the vertical-dispersing blades 71 caused thereby, and the dispersing of the cool air according to the operation thereof are the same with those of the embodiment shown in FIGS. 22 through 24, so the description thereof is not repeated here.

Figure 29:
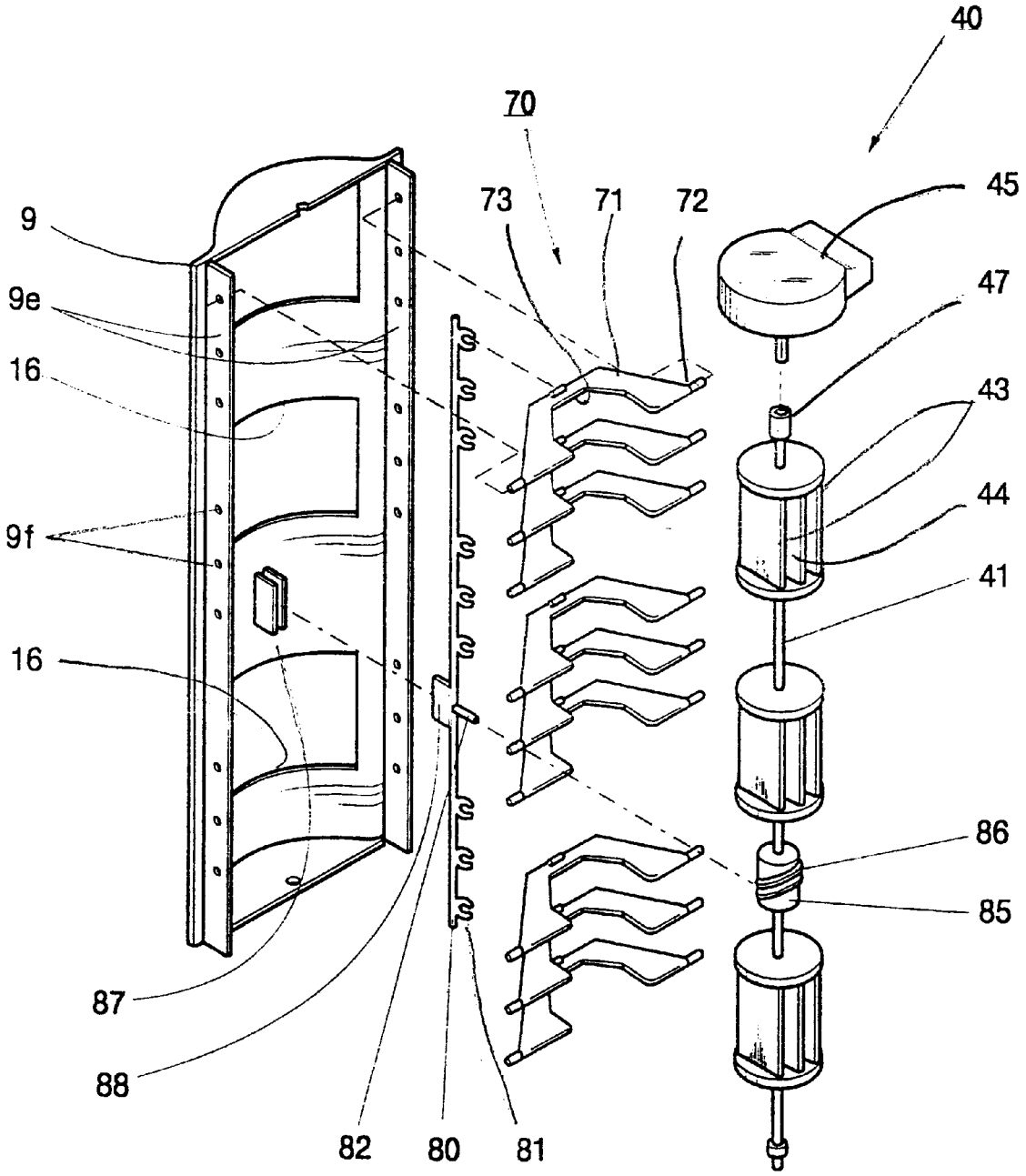
FIG. 29 is an exploded perspective view of main elements of the sixth embodiment of the present invention.
Figure 30:
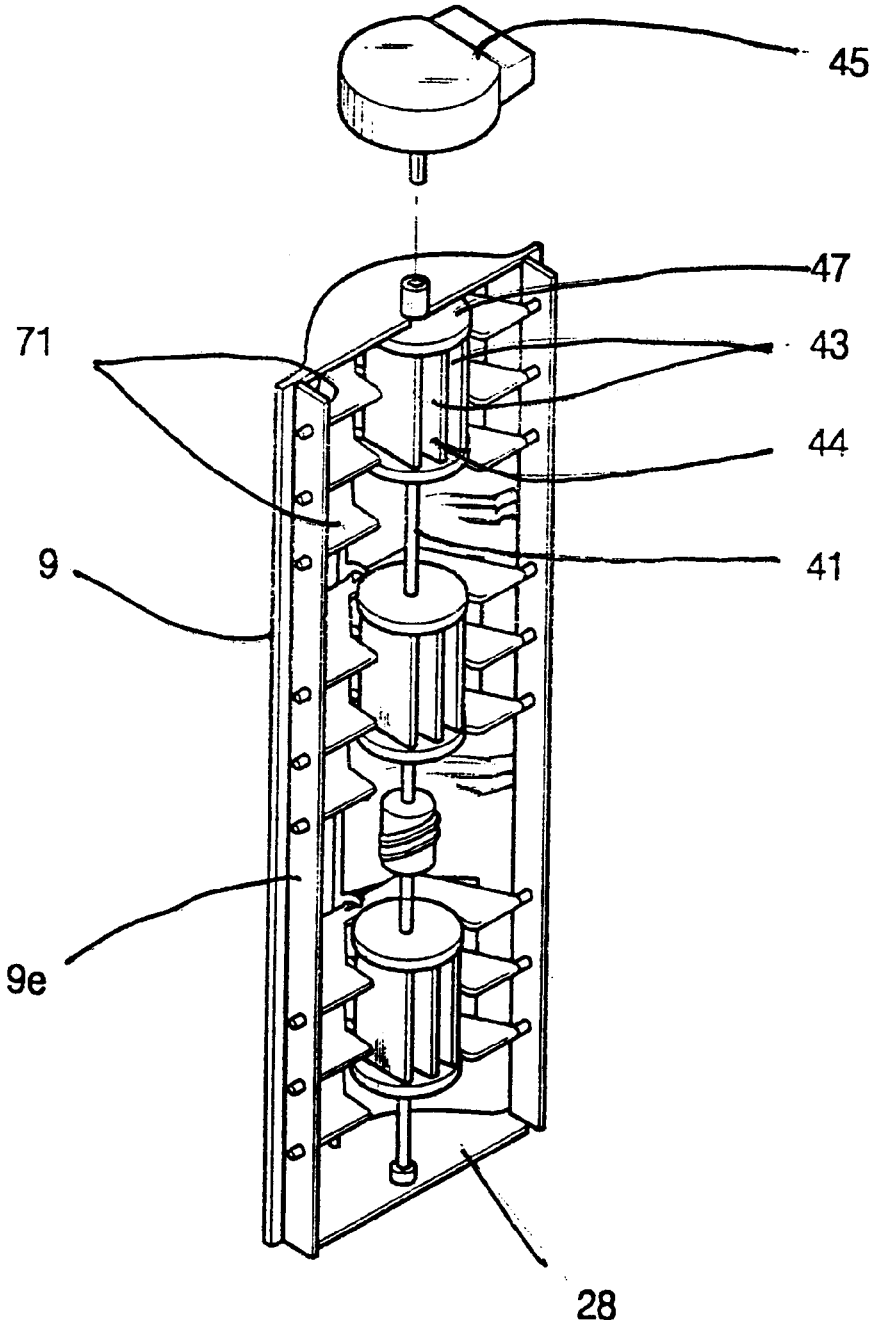
FIG. 30 is a perspective view showing the assembled state of FIG. 20.

FIG. 29 is an exploded perspective view of the cool air dispersing device according to the sixth embodiment of the present invention, and FIG. 30 is a perspective view showing the assembled state thereof. The present embodiment has substantially the same construction with the fifth embodiment shown in FIGS. 25 through 28. The only difference is that an additional horizontal-dispersing, blade 44 is installed between a pair of horizontal-dispersing blades 43. The additional horizontal-dispersing blades 44 are spaced from and disposed in parallel with the existing horizontal-dispersing blades 43. This embodiment shows that the number of the horizontal-dispersing blades can be increased in consideration of the situation, and the cool air can be more uniformly dispersed as the number of the horizontal-dispersing blades increases.

As described above, according to the refrigerator having the cool air dispersing device of the present invention, a stable cool air flow and a uniform distribution of the cool air can be achieved without the vortex of the cool air about the cool air discharge ports. Furthermore, according to the preferred embodiment of the present invention, the uniform distribution of the cool air can be achieved not only in horizontal direction but also in vertical direction.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cooling compartment for storing food, and a duct being provided in a side wall of said cooling compartment, said duct forming a cool air passage, and having at least one cool air discharge port opened into said cooling compartment, said refrigerator comprising:

a pair of horizontal-dispersing blades of planar plate shape being disposed near the cool air discharge port in said duct, said horizontal-dispersing blades being spaced from each other at a predetermined distance and being disposed at opposite sides to each other with a vertical axis disposed therebetween;

a rotational shaft being connected with said horizontal-dispersing blades, said rotational shaft being extended along the vertical axis; and a motor for driving said rotational shaft.

2. The refrigerator as claimed in claim 1, further comprising a connecting bar for connecting said horizontal-dispersing blades with each other, wherein said rotational shaft is assembled with said connecting bar.

3. The refrigerator as claimed in claim 1, wherein said cooling compartment is divided into a plurality of storing areas which are stratified vertically and correspond to at least one of the cool air discharge ports, and the cool air discharge port has a shape of a partial cylinder.

4. The refrigerator as claimed in claim 3, wherein the cool air discharge ports are linearly arranged, and said horizontal-dispersing blades are extended throughout all of the cool air discharge ports.

5. The refrigerator as claimed in claim 3, wherein a pair of said horizontal-dispersing blades are disposed at each of the cool air discharge ports, and the horizontal-dispersing blades in each pair are connected with each other by a connecting bar assembled with said rotational shaft.

6. The refrigerator as claimed in claim 1, further comprising a connecting plate assembled at both ends of said horizontal-dispersing blades so as to connect said pair of horizontal-dispersing blades with each other, wherein said rotational shaft is assembled in a body with said connecting plate.

7. The refrigerator as claimed in claim 1, further comprising at least one outer auxiliary blade assembled at an outer surface of said horizontal-dispersing blade so as to protrude therefrom.

8. The refrigerator as claimed in claim 7, wherein said outer auxiliary blade can be orthogonal with respect to said horizontal-dispersing blade, and is tilted against the vertical axis.

9. The refrigerator as claimed in claim 8, wherein said outer auxiliary blade is formed into a semi-disc shape.

10. The refrigerator as claimed in claim 9, wherein said outer auxiliary blade has a pair of installation pins, and said horizontal-dispersing blade is formed with a pair of fixing holes engaged with said installation pins.

11. The refrigerator as claimed in claim 10, wherein one of said fixing holes is a slot so as to be capable of regulating a tilt of said outer auxiliary blade.

12. The refrigerator as claimed in claim 1, further comprising a central auxiliary blade disposed between said pair of horizontal-dispersing blades.

13. The refrigerator as claimed in claim 12, wherein said central auxiliary blade has two pair of installation pins, and said horizontal-dispersing blade is formed with a pair of fixing holes engaged with said installation pins.

14. The refrigerator as claimed in claim 13, wherein one of said fixing holes is a slot so as to be capable of regulating a tilt of said central auxiliary blade.

15. The refrigerator as claimed in claim 1, further comprising an additional horizontal-dispersing blade disposed in parallel with said pair of horizontal-dispersing blades.

16. The refrigerator as claimed in claim 15, wherein said additional horizontal-dispersing blade is disposed along the vertical axis.

17. The refrigerator as claimed in claim 1, further comprising:

at least one vertical-dispersing blade installed near the cool air discharge ports to be capable of pivoting about a horizontal rotational axis; and a means for pivoting said vertical-dispersing blade in a vertical direction.

18. The refrigerator as claimed in claim 17, wherein said vertical-dispersing blade pivots in a predetermined angular range.

19. The refrigerator as claimed in claim 17, wherein said pivoting means comprises:

a link member having a plurality of hinge assembly parts respectively assembled with said vertical-dispersing blades at positions distanced from said horizontal axis, said link member being capable of moving up and down in the vertical direction; and a means for elevating/de-elevating said link member.

20. The refrigerator as claimed in claim 19, wherein said elevating/de-elevating means comprises:

an elevation/de-elevation cam installed on said rotational shaft of said horizontal-dispersing blade and rotating together with said rotational shaft; and an operation part formed in a body with said link member, and interacting with said elevation/de-elevation cam so that a rotational movement of said elevation/de-elevation cam is transmitted to said link member as an elevational/de-elevational movement thereof.

21. The refrigerator as claimed in claim 20, wherein said elevation/de-elevation cam comprises a cylindrical cam body coaxially installed on said rotational shaft, and a cam groove which is a closed loop having an elevational/de-elevational cam profile at an outer surface of said cam body; and said operation part protrudes from said link member and is engaged with said cam groove.

22. The refrigerator as claimed in claim 21, further comprising a means for guiding said link member so as to be capable of moving up and down vertically while preventing rotation of said link member.

23. The refrigerator as claimed in claim 22, wherein said guiding means comprises:

a guiding piece protruding along an axis of said link member; and a guiding part formed at an inner surface of said duct, said guiding part into which said guiding piece is inserted to be capable of moving up and down.

* * * * *